US007381316B1

(12) United States Patent
Lee et al.

(10) Patent No.: US 7,381,316 B1
(45) Date of Patent: Jun. 3, 2008

(54) METHODS AND RELATED SYSTEMS FOR CARBON NANOTUBE DEPOSITION

(75) Inventors: Junghoon Lee, Wilmette, IL (US); Jaehyun Chung, Evanston, IL (US)

(73) Assignee: Northwestern University, Evanston, IL (US)

( * ) Notice: Subject to any disclaimer, the term of this patent is extended or adjusted under 35 U.S.C. 154(b) by 517 days.

(21) Appl. No.: 10/426,925

(22) Filed: Apr. 30, 2003

Related U.S. Application Data

(60) Provisional application No. 60/376,704, filed on Apr. 30, 2002.

(51) Int. Cl.
*C25D 13/10* (2006.01)

(52) U.S. Cl. ..... 204/483; 204/477; 204/490

(58) Field of Classification Search ..... 204/483, 204/477, 490
See application file for complete search history.

(56) References Cited

U.S. PATENT DOCUMENTS

| | | | | |
|---|---|---|---|---|
| 6,325,909 | B1 | 12/2001 | Li et al. | |
| 6,346,189 | B1 | 2/2002 | Dai et al. | |
| 6,455,021 | B1 | 9/2002 | Saito | |
| 6,879,143 | B2 * | 4/2005 | Nagahara et al. | 324/71.1 |
| 6,892,432 | B2 | 5/2005 | Nakayama et al. | |
| 6,914,372 | B1 * | 7/2005 | Akiyama et al. | 313/309 |
| 2002/0163079 | A1 | 11/2002 | Awano | |
| 2003/0102222 | A1 * | 6/2003 | Zhou et al. | 205/109 |

OTHER PUBLICATIONS

Chung, J; and Lee, J; Nanoscale Gap Fabrication and Integration of Carbon Nanotubes by Micromachining; Sensors and Actuators A; 2003, 229-235; vol. 104.

* cited by examiner

*Primary Examiner*—Kishor Mayekar
(74) *Attorney, Agent, or Firm*—Reinhart Boerner Van Deuren s.c.

(57) ABSTRACT

Deposition of individual carbon nanotubes using a combined ac and dc composite field, and a circuit apparatus for use therewith.

20 Claims, 26 Drawing Sheets

PRIOR ART (a)

Figure 22a
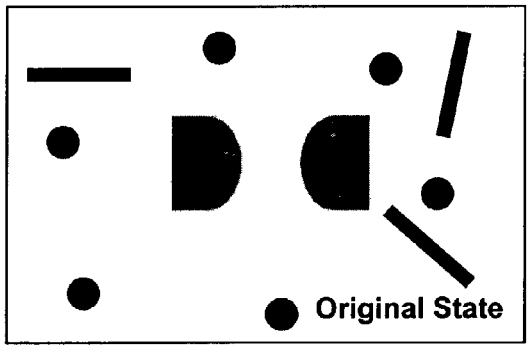
Figure 22b
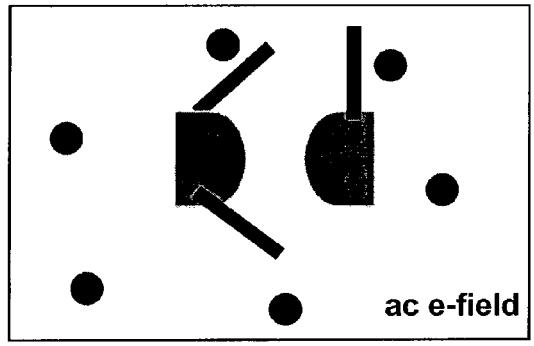
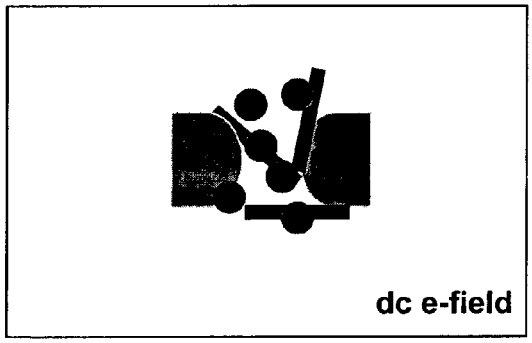
Figure 22c
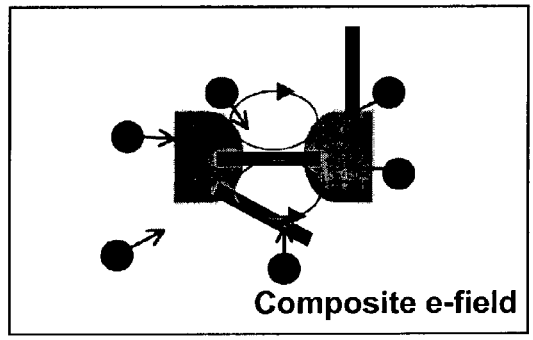
Figure 22d (a) Thermal oxidation (b) Al deposition(1st mask) , & RIE(2nd mask)

(c) CNT deposition (d) Adhesion layer

METHODS AND RELATED SYSTEMS FOR CARBON NANOTUBE DEPOSITION

This application claims priority benefit from provisional application Ser. No. 60/376,704 filed on Apr. 30, 2002, the entirety of which is incorporated herein by reference.

BACKGROUND OF INVENTION

Since their discovery in 1991 (S. Iijima, Helical Microtubules of Graphite Carbon, Nature, 354 (1994) 56-58), CNTs have been investigated for many applications due to their unique and useful characteristics. A CNT can be considered as graphene sheets composed of fullerene structure of carbon atoms rolled up to form a tube shape. Multi-walled CNTs (MWCNTs) are typically on the order of a few micrometers long with a diameter up to one hundred nanometers. In case of single-walled CNTs (SWCNTs), diameters less than a few nanometers and lengths over a few hundred nanometers are common. CNTs are considered promising electro- and mechanical components due to high aspect ratio and a high mechanical strength with a ~Tpa order of Young's modulus (D. Qian, G. J. Wagner, W. K. Liu, M. Yu, and R. S. Ruoff, Mechanics of Carbon Nanotubes, Appl. Mech. Rev. 55(6) (2002) 495-533). A CNT also shows fascinating electrical behavior such as semiconducting characteristics depending on chirality (P. L. McEuen, M. S. Fuhrer, and H. Park, "Single-Walled Carbon Nanotube Electronics", IEEE Transactions on Nanotechnology, 1 (2002) 78-85). Also, the conductivity of some CNT is extremely sensitive to external environment including gas species [P. G. Collins, K. Bradley, M. Ishigami and A. Zettl, Extreme Oxygen Sensitivity of Electronic Properties of Carbon Nanotubes, Science 287 1801 (2000)]. The electrical, mechanical, chemical properties and characteristics of CNTs lend themselves to various end-use applications, as known in the art.

For instance, CNTs and arrays thereof assembled on micro/nano systems are useful in conjunction with a range of nanotechnologies and related device structures. Examples include ultra-high sensitive chemical sensors [Y. Ren and D. L. Price Appl. Phys. Lett. 79, 3684 (2001); P. G. Collins, K. Bradley, M. Ishigami and A. Zettl, Science 287, 1801 (2000); J. Kong, N. R. Franklin, C. Zhou, M. G. Chopline, S. Peng, K. Cho and H. Dai, Science 287, 622 (2000)], material characterization [M. F. Yu, O. Lourie, M. J. Dyer, K. Moloni, T. F. Kelly, and R. S. Ruoff, Science 287, 637 (2000)], and nanoelectronic devices. For such applications, input/output functions require accurate, reproducible placement and integration of highly ordered CNT nanoscale structures. FIG. 1 shows schematically a CNT configuration of the prior art for chemical sensing by electromechanical transduction.

Chemical vapor deposition (CVD) and chemical patterning methods have been used, but with limited success. CVD with methane gas is used to grow CNTs individually or as an array [Y. Zhang, A. Chang, J. Cao, Q. Wang, W. Kim, Y. Li, N. Morris, E. Yenlimez, J. Kong, and H. Dai, Appl. Phys. Lett. 79, 3155 (2001)]. High operating temperatures (~900° C.) and extremely clean conditions are required to avoid the generation of amorphous carbon. With chemical patterning techniques, CNTs are deposited on a chemically functionalized region, but highly purified CNTs and complicated chemical treatment are necessary for successful deposition [Jie Liu, Michael J. Casavant, Michael Cox, D. A. Walters, P. Boul, Wei Lu, A. J. Rimberg, K. A. Smith, Daniel T. Colbert, Richard E. Smalley, Chemical Physics Letters 303 (1999) 125-129]. Process compatibility with either method and overall reliability remain critical issues.

The availability of highly-order CNT structures has remained a concern in the art. FIGS. 2(*a*) and (*b*) show deposition systems/methods of the prior art developed in response thereto. The electrostatic trapping method illustrated in FIG. 2(*a*) was designed originally to deposit a single Pd particle in an electrode gap [A. Bezryadin and C. Dekker, Appl. Phys. Lett. 71(9) (1997)]. A short circuit due to a reference resistance limits multiple depositions of Pd particles. However, the method was found unsuitable to the present concern as CNTs are not easily attracted by a direct current (dc) electric field and many unwanted particles in an applied CNT medium were instead deposited [K. Yamamoto, S. Akita, and Y. Nakayama, Appl. Phys. 31 (1998)]. FIG. 2(*b*) illustrates an alternating current (ac) electric field method of the prior art originally designed to deposit an Au rod in an electrode gap [P. A. Smith, C. D. Nordquist, T. N. Jackson, T. S. Mayer, B. R. Martin, J. Mbindyo and T. E. Mallouk, Appl. Phys. Lett. 77(9) (2000)]. The low resistance of the Au rod automatically limited multiple Au rod deposition. It was thought highly-oriented CNTs could be deposited between two such electrodes by applying an ac field, but multiple CNTs were observed as the depositions were not self-limiting [X. Q. Chen, T. Saito, H. Yamada, and K. Matsushige, Appl. Phys. Lett. 78(23) (2001)].

BRIEF DESCRIPTION OF THE DRAWINGS

FIGS. 22*a-d*. Schematic comparative deposition sequence, illustrating a composite field, in accordance with this invention.

SUMMARY OF THE INVENTION

Figure 1:
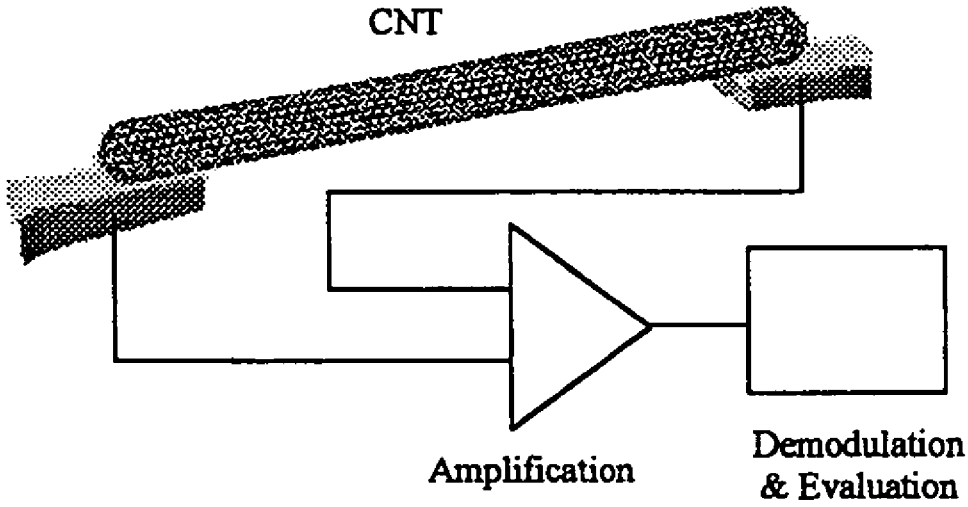
FIG. 1. Schematically, a component configuration of a prior art CNT-based sensor of the type which can be fabricated in accordance with this invention.
Figure 2A:
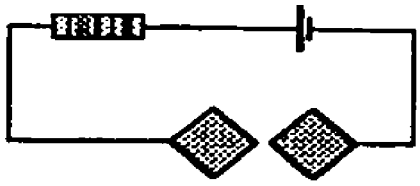
PRIOR ART Figure 2a
FIG. 2. Schematically, by comparison, circuits and configurations for (a) electrostatic de and (b) ac deposition methods of the prior art.
Figure 2B:
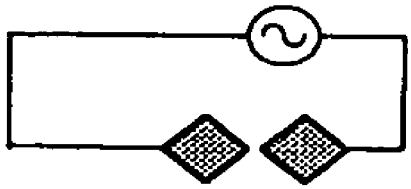

This invention relates to one or more methods and a circuit system or apparatus, for use in conjunction therewith, for deposition or assembly of carbon nanotubes (CNTs) using composite electric-field-guided techniques. This invention can enable reproducible production of automatically assembled array of CNTs without resort to time consuming and expensive techniques such as atomic force microscopy. The invention is thus suitable to mass production of CNTs integrated on a variety of micro/nano systems.

In light of the foregoing, it is an object of the present invention to provide a method and/or related system for deposition of carbon nanotubes, thereby overcoming various concerns of the prior art including but not limited to those outlined above. It will be understood by those skilled in the art that one or more aspects of this invention can meet certain objectives, while one or more other aspects can meet certain other objectives. Each objective may not apply equally, in all instances, to every aspect of this invention. As such, the following objects can be viewed in the alternative with respect to any one aspect of this invention.

It is an object of the present invention to provide a method and/or related system for the controlled deposition of a single carbon nanotube, with desired position and orientation upon or in association with a given substrate material.

It can also be an object of this invention, in conjunction with one or more other objectives, to provide for carbon nanotube deposition without introduction of or interference by extraneous, non-carbon and/or non-elongated particulates.

Other objects, features, benefits and advantages of the present invention will be apparent from the summary and the following description of preferred embodiments, and will be readily apparent to those skilled in the art having knowledge of various nano-deposition systems or fabrication techniques. Such objects, features, benefits and advantages will be apparent from the above as taken in conjunction with the accompanying examples, figures, data and all reasonable inferences to be drawn therefrom.

Accordingly, in part and with reference to certain embodiments, the present invention is a general method of carbon nanotube deposition. The inventive method includes (1) providing a substrate with spaced or gapped first and second electrodes positioned thereon; (2) introducing on the gap and/or proximate the electrodes, at least one carbon nanotube, as can be part of a suitable solution of or liquid medium containing such carbon nanotubes; and (3) applying a voltage and/or generating an electric field across the electrodes, the field having a direct current/field component and an alternating current field component. As would be understood by those skilled in the art, various techniques of the prior art can be used to prepare a suitable substrate electrodes and circuit apparatus for deposition, such techniques including but not limited to lithography-based microfabrication. Likewise, carbon nanotubes, whether single- or multi-walled, are available either commercially or through well-known synthetic techniques. Such nanotubes can also vary by diameter and/or length as required for a particular end-use application. As described below, field frequencies and related circuit parameters can also be varied to control deposition. Removal of such electrodes and/or related circuit components, as known in the art, can provide a CNT or an array thereof for further use in device fabrication.

More specifically, the present invention can also relate to one or more methods for using either an ac component and/or a dc component of a composite electric field, consistent with the results and observations described herein. Regardless, with respect to carbon nanotube deposition, such a method employs a ratio of the dc electric field component to the ac electric field component, at an applied voltage over the electrode gap distance. The ratio of such electric field components is adjusted, as described elsewhere herein, so as to provide desired deposition. In certain embodiments, the ac electric field component is sufficient to attract a carbon nanotube toward the electrodes. Likewise, in certain embodiments, the dc electric field component is sufficient to align carbon nanotubes between the electrodes. Regardless, deposition is conducive, in accordance with this invention, where one or more gradients of the generated electric field between the electrodes is zero. As described more fully below, peripheral electrode and/or electrode gap configuration can be designed to provide one or more gradients within an applied composite electric field conducive for deposition. Arcuate peripheral configurations provided by semi-circular or semi-eliptical electrodes can be utilized with certain embodiments of this invention, while square or rectangular peripheral configurations can be used in conjunction with certain other embodiments.

As discussed elsewhere herein, a plurality or array of electrode configurations can be provided for corresponding deposition therebetween. In certain embodiments, the composite electric field is beneficially distributed over the array or plurality of electrode pairs, the distance between such pairs as may be adjusted so as to reduce composite electric field interference therebetween. The ratio of the dc electric field component to the ac electric field component can be adjusted, at an applied voltage over the electrodes of each pair in the array, the adjustment as required to provide desired and corresponding deposition between the electrodes of each pair. Again, one or more zero gradients of the composite electric field between each said electrode pair is conducive to deposition. Depending upon electrode/gap configuration, a generated electric field comprises a plurality of regions having zero gradient, for deposition of a single carbon nanotube therein. Carbon nanotube deposition over multiple gaps in an electrode array is demonstrated by way of one or more examples, below.

In part, the present invention also comprises a method of using a composite electric field to enhance single carbon nanotube deposition. Such a method comprises (1) introducing a plurality of carbon nanotubes proximate to a pair of electrodes; and (2) applying a composite electric field across the electrodes, the field comprising a dc electric field component concurrent with an ac electric field component. The combined ac and dc components are sufficient to attract a carbon nanotube. As mentioned above and discussed more fully below, a ratio of the dc component to the ac component, at an applied voltage across the electrodes, can be adjusted to enhance desired deposition. Depending upon electrode/gap configuration, the composite electric field can comprise one or more regions having a zero gradient. Adjustment of the aforementioned electric field ratio can, as illustrated below, provide for a single carbon nanotube deposition within each such region.

The present method(s) can be extended, in its broader aspects, to the deposition, placement or orientation of other particles which are, in accordance with this invention, affected by a composite electric field of the type described herein. Such particles are limited only by the effect of such a field thereon and the ordered deposition thereof. MWCNTs can be used effectively herewith, in that dimensions typical of such structures are beneficially useful in conjunction with the dimensions of associated circuits and electrodes. Regardless, SWCNTs can also be deposited, in accordance with this invention, with good results. DNA and related compositional strands or sequences are also so affected and deposited consistent herewith. Regardless, such CNTs are, in certain embodiments, provided and/or dispersed, as described below, within a liquid medium for introduction to, between and/or proximate to an electrode configuration. Consistent with discussion elsewhere herein, one or more carbon nanotubes are introduced thereby so as to be affected by the generated or applied composite electric field for deposition between or across the electrode configuration.

In part, the present invention can also include a composite current apparatus for deposition of carbon nanotubes. Such an apparatus comprises first and second electrodes in electrical connection with a circuit comprising an ac current source in series with a dc current source, a dc circuit path in series with the ac and dc current sources and an ac circuit path in parallel with the dc circuit path. The electrodes define a gap in the circuit, with the circuit capable of applying dc current across the dc circuit path upon deposition of a carbon nanotube across or between the electrodes. The ac and dc current sources generate an applied voltage cross the electrodes, the voltage providing a composite electric field sufficient to attract carbon nanotubes thereto. Without limitation, an applied voltage is typically about 1V to about 5V and the gap or distance between electrodes is typically about 1 μm to about 7 μm. Likewise, without limitation, the ac current path comprises at least one capacitor, and the de circuit path comprises at least one resistor. Regardless, such a circuit or apparatus operated as described herein can further comprise a carbon nanotube across or between the electrodes. While certain suitable substrate, electrode and other circuit components are described herein, various other components can be utilized consistent herewith as would be known to those skilled in the art made aware of this invention. For example, such components and any circuit or electrode gap configured therewith can be sub-micron-dimensioned, such dimensions limited only by implementation of available lithographic tools or other useful circuit fabrication techniques. As related thereto, the methods of this invention, as may be used in conjunction with such a circuit or apparatus can employ a range of composite electric fields and/or maximum nominal values thereof over a corresponding range of micron-dimensioned gap distances and applied voltages. Likewise, such composite electric fields and aspects thereof can be reduced in conjunction with sub-micron-dimensioned circuit components and/or electrode gap, such components or gaps limited only by implementation of available lithographic tools or other useful circuit fabrication techniques.

An especially useful aspect of this invention is controlled, selective CNT deposition. As described more fully below, a short circuit induced upon deposition of a single CNT restricts or limits further placement or orientation. Unlike prior art CNT growth techniques, the present assembly methods and techniques can readily control the orientation and number of deposited CNTs. The methods and related assembly can also be effected under ambient conditions, for instance at room temperature and 1 atm, thus providing more process freedom and the feasibility for economic batch production of an array of ordered CNTs and related device structures.

This invention embodies use of an electric field for the assembly of a single carbon nanotube across a circuit/electrode gap. It is demonstrated herein that a composite electric field with an ac electric field component combined in series with a dc electric field component can be applied to attract and assemble a single CNT among many dispersed in a liquid, and effectively prevent the multiple deposition of CNTs between electrodes.

Without restriction to any one theory or mode of operation, dielectrophoretic force and electrophoretic force are believed involved. Dielectrophoretic force differs from an electrophoretic force in that the former is induced from polarizability of particles surrounded by an inhomogeneous electric field, whereas the latter arises from the electrostatic force by dc and ac fields between electrodes and charged particles. Dielectrophoretic force can occur with an ac electric field and an ac frequency ranging from about 10 kHz to about 10 MHz, and can be expressed in equation (1) for a spherical particle [H. A. Pohl, The Motion and Precipitation of Suspensoids in Divergent Electric Fields", J. Appl. Phys. 22 (1915) 869-871], $$F_{DEP} = 2\pi a^3 \varepsilon_m \mathrm{Re}\left[\frac{\varepsilon_p^* - \varepsilon_m^*}{\varepsilon_p^* + 2\varepsilon_m^*}\right]\nabla |E|^2, \tag{1}$$

where a is the longest dimension of the particle, $\in_m$ the dielectric constant of the medium, $\in_p$ the dielectric constant of the particles, and E electric field. The frequency dependent, complex dielectric constants shown with the asterisk are expressed by the combination of normal dielectric constants and conductivities (σ) shown in equations (2) and (3).

$$\in_p^* = \in_p - \sigma_p \omega \tag{2}$$

$$\in_m^* = \in_m - \sigma_m \omega \tag{3}$$

where ω is the frequency of the applied ac electric field.

Dielectrophoretic force is generated by an induced dipole in an inhomogeneous electric field. This induced dipole, or polarization, can move, translate, and rotate an object along the gradient of electric field. Larger polarizability can be induced at a longer object attracted easily in a nonuniform field. Since CNTs are longer than particles such as catalysts and amorphous carbon debris as shown in Scheme 1, the larger dipole—and thus the larger dielectrophoretic force—is induced.

Scheme 1. Dipole on a CNT and a particle due to inhomogeneous electric field

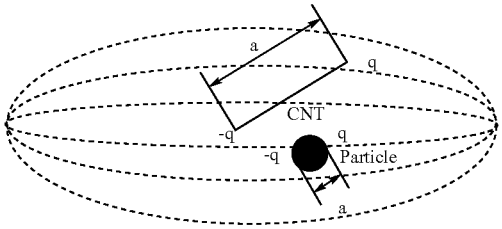

Consistent with such principles, CNTs can be filtered out from a mixture with other small particles and selectively deposited between electrodes. It was observed that CNTs, as well as other particles, were attracted by a dc electric field. However, it was found that CNTs were slow to respond to a dc electric field, while many unwanted particles in the CNT solution were more easily deposited. CNTs could be more easily attracted by a high-frequency (typically, but not limited to ~5 MHz) ac electric field, as described herein. Unwanted particles were not attracted by the dielectrophoretic force and could be excluded from the deposition process. An ac electric field component is effective in selectively filtering out and depositing CNTs between electrodes.

Recent observation and analysis suggest particles larger or longer than an electrode gap distance are initially attracted to or near the gap, but do not remain aligned thereacross, as large dielectrophoretic forces expel such particles from the gap's center. This can explain why most CNTs attracted by a pure ac electric field are not gap-aligned, and in any event smaller than the gap dimension.

When a dc electric field is applied across a gap, an electrostatic force arises between charged particles and electrodes. This electrophoretic force can be combined with a dielectrophoretic force originated from an ac electric field. Preferably, neither the dc nor the ac component of the total electric field is effective to attract, align, and deposit a single CNT across a gap. Instead, a combination of the two fields is devised to play such a role. Once a single CNT is deposited, the dc component is diminished using a high external resistance.

As a further variation on the preceding, the observed results can be explained by an electrohydrodynamic flow created between electrodes along a CNT by the dc component of an applied composite field. Such an electrohydrodynamic flow can be ascribed to instability initiated by pressure built up between the electrodes by electrolysis due to the dc current. If a particle causes a perturbation to this instability, a flow can be created along the particle. Moreover, the induced flow creates periodic flow cells (i.e., circulating flow patterns periodically arranged along the electrodes). Periodicity of such a mechanical flow in an unrelated context was previously demonstrated [Langmuir 13, 6357 (1997); Science 272, 706, (1996)]. Deposition of the first CNT can cause such a periodic flow cell preventing access of other CNTs to the electrodes. Such a flow may also be at least in part responsible for directional deposition. Further, an electroosmotic flow believed to exist between electrodes can also contribute to directional deposition [Chem. Eng. Commun. 38, 1985, pp 93]. When the resistance of the deposited nanotube is sufficiently small, the effect of dc electric field will also be terminated by short circuit. Further deposition of CNTs across the gap cannot occur by ac field alone.

By way of further illustration, FIGS. 22*a-d* show a schematic sequence of deposition results of an ac-, a dc, and a composite electric field, as compared to (a) before applying an electric field. (b) At an ac electric field (at 5 MHz), only CNTs are attracted irrespective of deposition time, but little deposition was observed when the CNT length is much larger than the gap size. (c) At a dc electric field, CNTs and particles are randomly attracted without orientation. (d) At a composite electric field, CNTs are quickly attracted and placed across the gap and particle movement is relatively slow. Electrohydrodynamic and/or electroosmotic flow is expected due to a dc electric field. By manipulating the ratio, $E_{dc}/E_{ac}$, and the amplitude of an applied electric field, the number of deposited CNTs is controllable.

As described below, in the following examples, to assess gap shape, the electric field was analyzed by simulation to observe the field distribution related to gap geometry. It was found that a sharp-shaped gap was not favorable in attracting a CNT across it. Semi-elliptical shaped gaps could provide a quasi-stable region in the gap. An electric field across the gap maintains the dielectrophoretic force directed towards a midline: the field is stable in this direction, but unstable in a direction perpendicular thereto. While a CNT would be attracted in such a midline direction by an ac field, the dc electric field produces a flow that contains the CNT in the center. Other CNTs outside of this cell are restricted due to the flow.

DETAILED DESCRIPTION OF CERTAIN EMBODIMENTS

Figure 3:
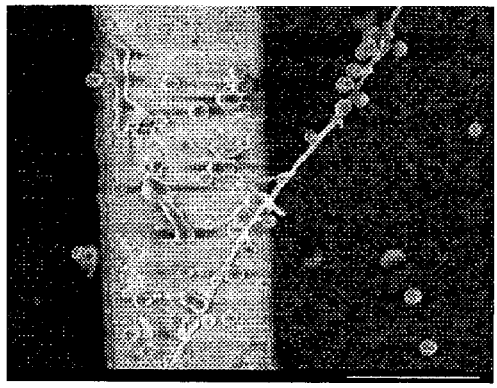
FIG. 3. SEM image of CNT deposition with an e-field 0.544 Vrms/μm (a) de e-field($E_{DC}/E_{AC}=\infty$) (b) composite e-field($E_{DC}/E_{AC}=1.22$) (c) ac e-field($E_{DC}/E_{AC}=0$).
Figure 3:
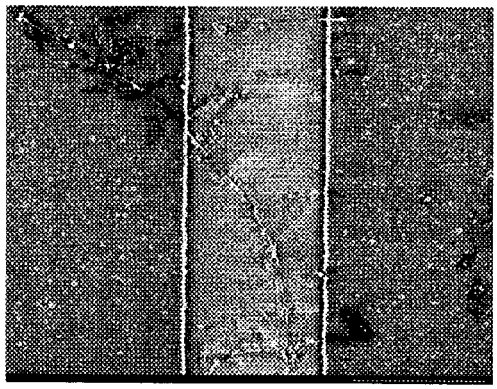
Figure 3:
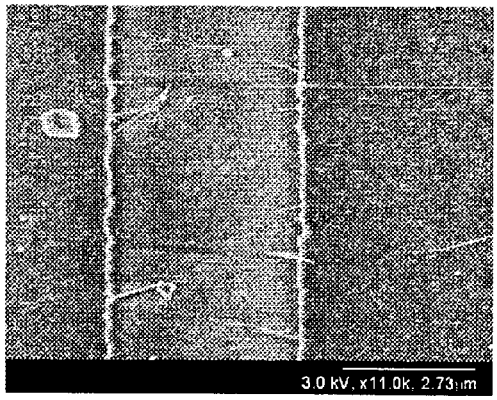

A range of related thin-film and/or lithographic techniques can be employed, as known in the art, to provide a circuit and/or apparatus structure to effect the deposition methods of this invention. Further detail and such variations include those techniques illustrated in several of the following examples. More particularly, with reference to FIG. 3, Al electrodes can be patterned (1000 Å) by well-known microlithographic techniques on a 2000 Å $Si_3N_4$ film on an Si substrate. Subsequently, the substrate film was etched by reactive ion etching (RIE). The fabricated electrode gap is schematically shown in FIG. 3. The gap can be ~3-4 μm wide and up to ~300 μm long. The gap distance or separation can be fabricated smaller than the average CNT length for overlap and electrical contact with the electrodes. An array of electrodes/gaps and the corresponding circuitry can be readily patterned, not limited but typically by repeating such thin film and/or lithography-based microfabrication techniques.

Figure 5:
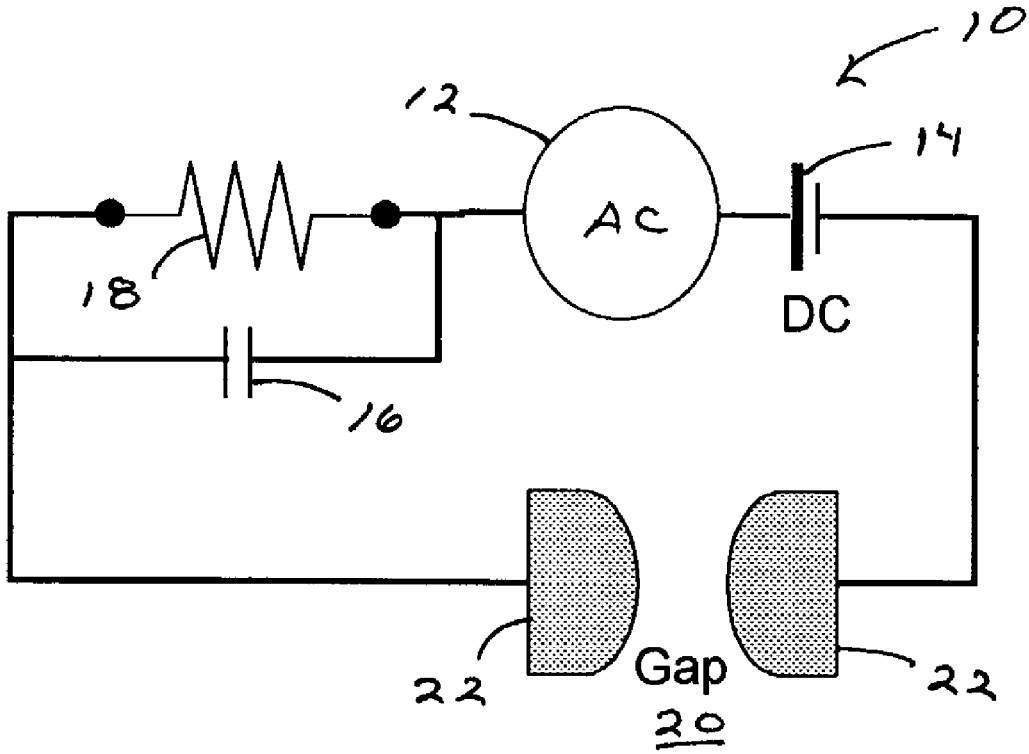
FIG. 5. Single CNT deposition circuit and apparatus, in accordance with this invention.

Multi-walled carbon nanotubes (MWCNTs) were suspended in methanol solution and sonicated for several hours to disperse CNTs in the solution. With reference to FIG. 5, a drop of the solution was applied on the gap with a biased ac electric field applied thereacross. After deposition, the sample was dried, and images were taken by scanning electron microscopy (SEM). Optimal deposition conditions, dc and ac fields strengths and ac frequency, can be empirically determined and varied as required for a particular nanotube or source thereof, and as would be well known to those skilled in the art. For example, a single CNT deposition was achieved with an ac field of 0.47 $V_{rms}$/μm@5 MHz and a corresponding dc component field of 0.27 V/μm. Consistent and repeatable results are obtained under a corresponding range of circuit, frequency and field conditions as can vary with a given nanotube solution and/or gap size.

As demonstrated herein, the biased ac method (i.e., ac mixed with dc) of this invention can effectively avoid deposition of undesirable particles by using a specific frequency component to selectively drive desired CNTs into an electrode gap by dielectrophoresis. The motions of other solution particles or cluster of CNTs are filtered out during this process. Adding a dc component to the ac field initiates a flow between electrodes when the first CNT is deposited across the gap. Further deposition was essentially prohibited by the flow cell created. When the resistance of the deposited nanotube is sufficiently small, the effect of dc electric field will also be terminated by short circuit. By varying deposition parameters, a wide range of CNTs (e.g., different lengths and diameters) can be assembled on various integrated micro/nano systems as desired or required for end-use application.

CNT deposition, in accordance with this invention, can be used to fabricate ultra-high sensitive chemical sensors for detecting gas molecules, e.g., oxygen, hydrogen, and nitrogen etc., as well as physiological sensors for detecting glucose level, $CO_2$ level, and various vital signs with high sensitivity and accuracy. The CNT device can also be used to detect biomolecular recognition such as DNA hybridization or antibody-antigen reaction. Nano electronic components, as could be used in high speed nano mechanical memory systems, can also be fabricated using the techniques and methods of this invention.

EXAMPLES OF THE INVENTION

The following non-limiting examples and data illustrate various aspects and features relating to the methods and/or apparatus of the present invention, including the deposition of various carbon nanotubes and circuit components/apparatus useful in conjunction therewith. In comparison with the prior art, the present methods provide results and data which are surprising, unexpected and contrary thereto. While the utility of this invention is illustrated through the use of certain carbon nanotubes and circuit configurations that can be used therewith, it will be understood by those skilled in the art that comparable results are obtainable with various other such nanotubes and apparatus, as are commensurate with the scope of this invention.

For purposes of the following examples and demonstrating various aspects of this invention, it was assumed that the composite electric field ($E_c$) is the linear combination of an ac electric field ($E_{ac}$) and a dc electric field ($E_{dc}$). Based on this assumption, the root mean square (rms) value of this electric field ($E_{rms}$) can be described as in equation (4).

$$E_{rms}=\sqrt{E_{ac}^2/2E_{dc}^2} \quad (4)$$

The proper rms value of this field was empirically found where a few CNTs were deposited by a pure ac field. In this case the value was 0.544 $V_{rms}$/μm. This value is the maximum nominal value of an electric field at a gap. For example, if the gap size is 5 μm and the applied voltage is 2.5V, the maximum nominal strength of an electric field is 0.5 V/μm. In further experiments, as provided below, the ratio of the dc to the ac electric field (i.e., $E_{dc}/E_{ac}$) was manipulated while the rms value of any electric field with the equivalent amplitude was maintained constant as shown in Scheme 2: assuring that only the combined electric field was strong enough to attract CNTs. Short circuit, filtration, and orientation can be effected by varying this ratio between ∞ and 0.

Scheme 2. Equivalent electric field on a composite electric field

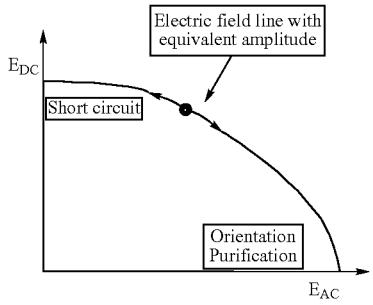

Example 1a

Figure 4:
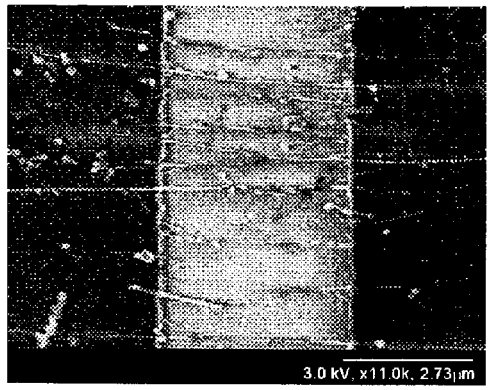
FIG. 4. SEM image of CNT deposition with an e-field 0.544 Vrms/μm (a) composite e-field($E_{DC}/E_{AC}=0.41$) (b) composite e-field($E_{DC}/E_{AC}=0.32$) (c) composite e-field ($E_{DC}/E_{AC}=0.22$).
Figure 4:
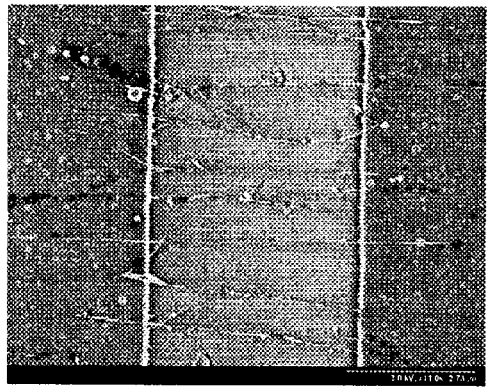
Figure 4:
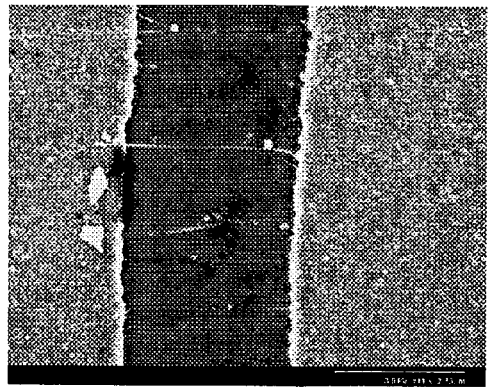

FIG. 3 and FIG. 4 illustrate a composite field tuning procedure to adjust the dc/ac ratio. A gap by flat electrodes was used for the tuning process. When only a dc electric field ($E_{dc}/E_{ac}=\infty$) was applied across the gap in FIG. 3, round particles were gathered between electrodes, and a few carbon nanotubes were attracted and randomly distributed [FIG. 3(*a*)]. When the ratio was 1.22, more CNTs were attracted with fewer round particles gathered in the gap [FIG. 3(*b*)]. Although some CNTs were arrayed periodically, others were randomly placed without orientation.

Example 1b

When only an ac field was applied ($E_{DC}/E_{AC}=0$), particles were rarely gathered and a few CNTs were attracted [FIG. 3(*c*)]. A few CNTs were attached together and the CNTs whose length was shorter than the gap size were attached to either side of the electrodes.

Example 1c

FIG. 3 shows the cases when the ratio, $E_{DC}/E_{AC}$ is between 0 and 1. CNTs were periodically deposited in these cases. This periodicity is attributed to the periodic hydrodynamic flow created by dc component of the electric field. As the ratio decreased, i.e., as ac component becomes stronger, the period between deposited CNTs became larger with the decreasing number of deposited particles.

Example 1d

When the ratio was 0.41, CNTs were orderly deposited across a gap and a small number of particles were attracted [FIG. 4(*a*)]. When the ratio was 0.32, the average distance between CNTs became larger from 0.76 μm in FIG. 4(*a*) to 0.84 μm in FIG. 4(*b*). As the ratio became as small as 0.22, this distance became 1.7 μm and fewer particles were deposited [FIG. 4(*c*)]. This ratio can be optimally tuned to deposit a single CNT across a gap defined by electrodes of a particular shape.

Example 2a

FIG. 5 is a schematic diagram representing an electrical circuit 10, in accordance with this invention, for deposition of a single CNT. Ac (12) and dc (14) voltage sources are serially combined to generate a composite electric field. A waveform or function signal generator as known in the art can be used to combine the dc and ac currents/fields, as desired for a particular ratio and composite field effect. A capacitor 16 is provided parallel to a high resistance to manipulate the composite electric field, as described herein. Such a capacitor can be a component of an ac current path with negligible amplitude loss. Such a resistor 18 can be a component in a dc circuit path to induce a high electric field strength at an electrode gap 20 before deposition and to decrease field strength after deposition with a short-circuit. The resistor and capacitor capabilities/values can be varied as required for a particular applied voltage, frequency and/or amplitude, or the electrical characteristics of a particular carbon nanotube. The combined strength of a composite electric field attracts and aligns only CNTs. The dc component by itself is not enough to attract unwanted particles between electrodes. Also, the ac component does not attract non-elongated particles since the dielectrophoretic force is negligible for the particles with small length dimensions. It was observed that such particles were left precipitated along the outer edge of a dried-out sample droplet away from the electrodes 22.

Example 2b

When a first CNT is deposited, the dc component of the electric field will induce a electrohydrodynamic flow between electrodes. This flow cell will prevent the access of other CNTs to the gap. The first deposited CNT will align and stay across the gap due to this flow and dielectrophoretic force. If the deposited CNT has low resistance, the effect of this dc field will substantially diminishor terminate because of the large series resistance (~1 GΩ) in the circuit. In other words, all the dc potential was applied across the large resistance rather than across the gap through the deposited CNT. The ac component alone was not effective enough to attract, align, and deposit more CNTs quickly toward the gap. For example, the dielectrophoretic force can attract CNTs along the central axis between the electrodes, but will actually repel them along the axis perpendicular to the central axis. Further deposition of CNTs can be prevented by adjusting the strengths of the ac and dc components in such a way.

A capacitor (~22 μF) enables the ac voltage to pass through the circuit with the gap and the large resistance. Without the capacitor, most of the ac voltage would be applied across the large resistance because of the low impedance of the gap (i.e., capacitance) at the high frequency of the ac component.

Example 3

Figure 6:
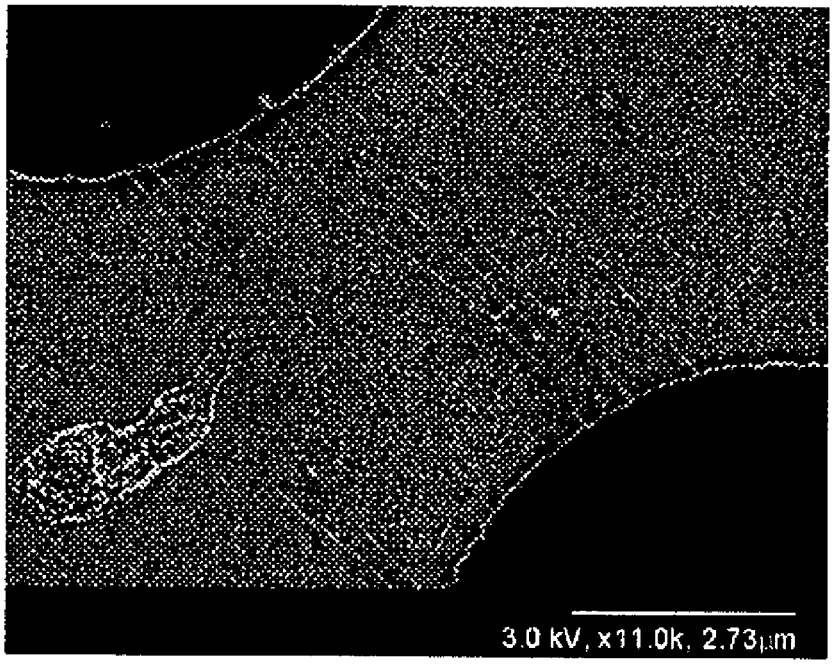
FIG. 6. Unsatisfactory tuning result with the rms e-field of 0.544 $V_{rms}$/μm (a) multiple deposition($E_{dc}/E_{ac}=0.71$) (b) cross deposition of CNTs ($E_{dc}/E_{ac}=0.33$).
Figure 6:
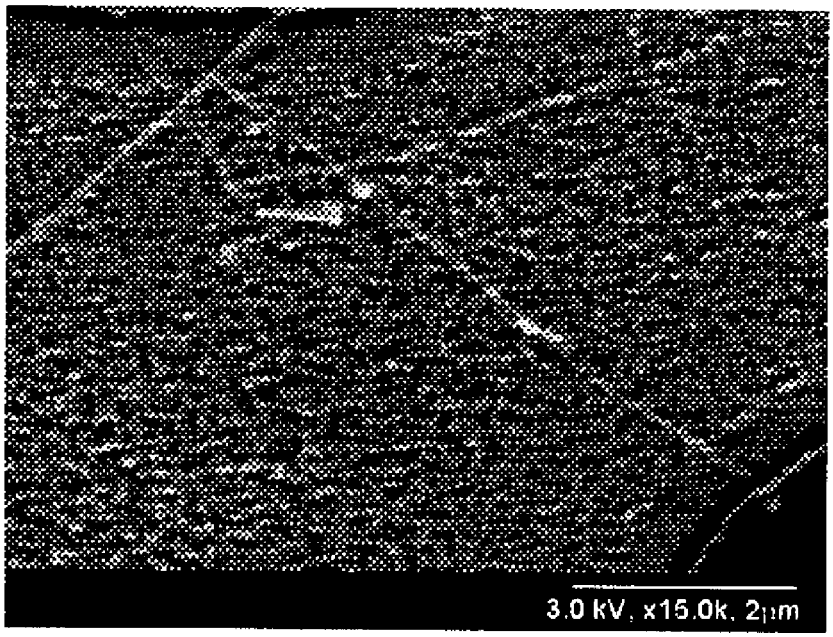

In FIG. 6, the above-mentioned procedure was used for deposition across a round shaped gap. While the rms value of the electric field was maintained @0.544 $V_{rms}$/μm, the ratio of the dc to the ac was tuned between 0~1. When a composite electric field ($E_{dc}/E_{ac}$=0.71) was applied, several CNTs were connected parallel to the electric field as shown in FIG. 6(*a*). It has been observed in FIG. 4 that the period between CNTs became larger when the dc component was diminished. The ratio thus was decreased to increase the spacing. When the ratio was small enough ($E_{dc}/E_{ac}$=0.33), a single CNT deposition was obtained, but the deposited single CNT was crossed by other CNTs, as shown in FIG. 6(*b*). It was observed that the crossing of CNTs occurred when the ratio was too small. Therefore, the ratio was increased back again until a single CNT was deposited on a gap without the crossing (not shown) by other CNTs ($E_{dc}/E_{ac}$=0.39).

Example 4

Figure 7:
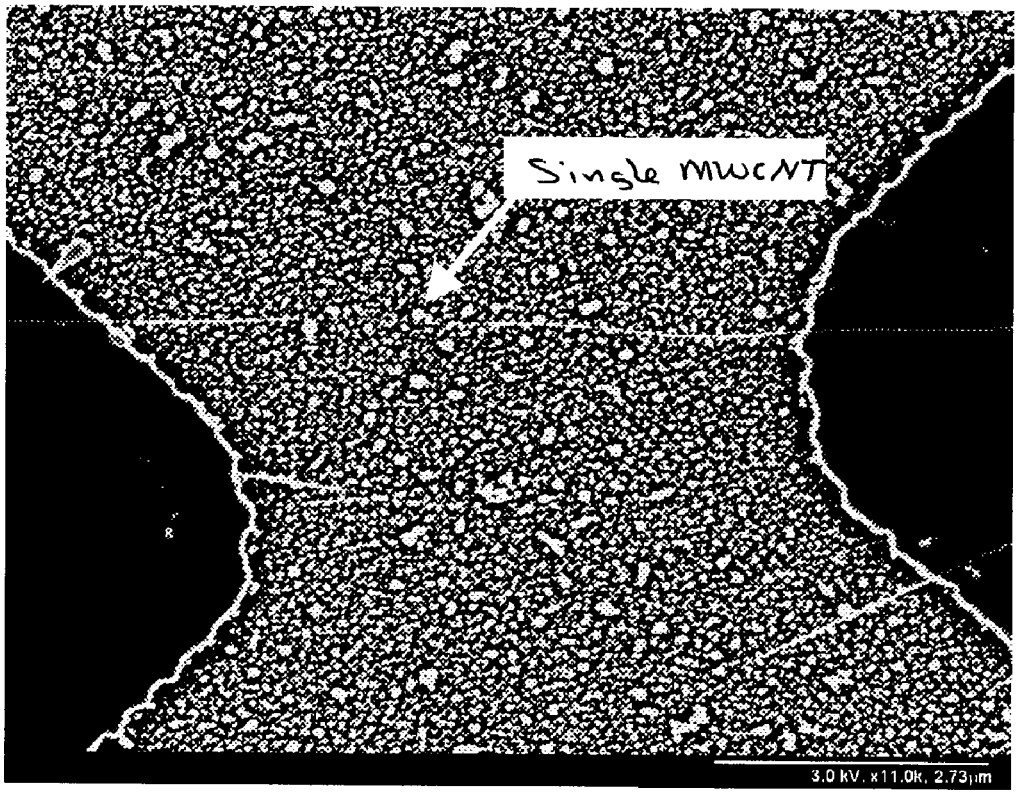
FIG. 7. Single MWCNT deposition with the composite electric field guided assembly method, 0.544 $V_{rms}$/μm@5 MHz ($E_{dc}/E_{ac}=0.41$).

The deposition of a single CNT was accomplished without crossing CNTs when the optimal values were determined as described. (ac electric field=0.47 $V_{rms}$/μm@5 MHz; and dc field=0.27 V/μm). FIG. 7 shows the deposition result for a single CNT, which were highly reproducible and consistent under these tuned conditions for the given sample and the gap shape. Also, similar results were obtained when glass substrates were used instead of Si substrates. Thus results appear not dependent on substrate materials.

As demonstrated by the following, several other parameters can be utilized to improve the yield of a single CNT deposition, such as a gap shape, the concentration of a CNT suspended solution, the drying-out time of a solution for deposition. Gap shape, as can be provided by electrode configuration, can be used to manipulate the shape and strength of an electric field and effect stable deposition results. Simulation results on electric field for different gap shapes are provided.

Considering that the gradient of the square of an ac electric field around a gap is proportional to a dielectrophoretic force in equation (1), a highly concentrated electric field is less likely to attract CNTs, since the steeper change of the strength of an electric field the smaller the region of quasi-stable electric field. CNTs will temporarily stay at the quasi-stable region where the gradient of the square of an electric field is 0 ($\nabla|E|^2=0$) during the deposition. This region is not absolutely stable. For this reason, it can be desirable to provide such a region as broad as possible. To assess such quasi-stable regions, an electric field was simulated using commercially available FEMLAB software.

Example 5

Figure 8:
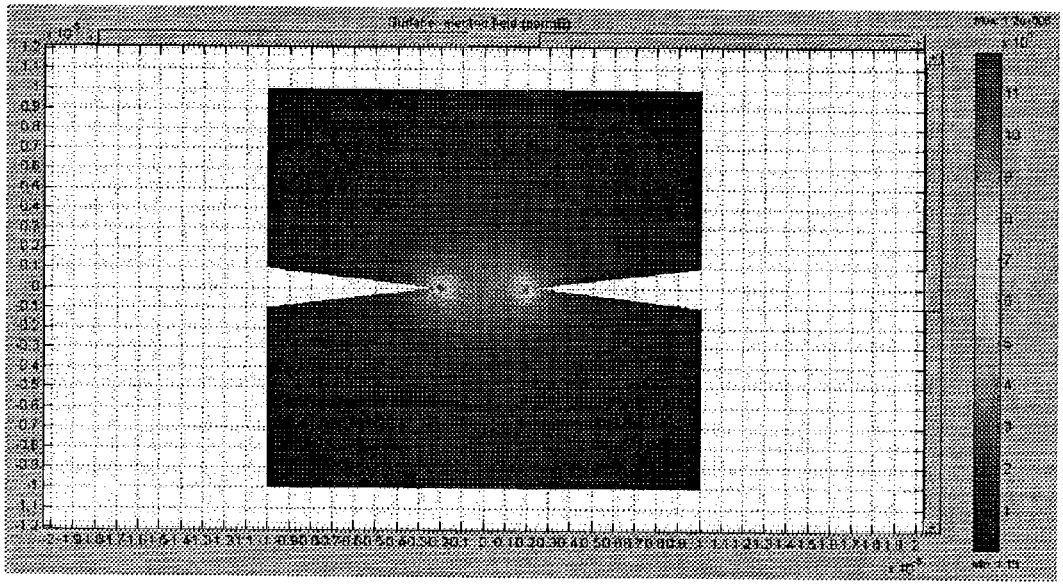
FIG. 8. Electric field simulation result on a sharp gap, nominal electric field=0.5 V/μm.

Utilizing such simulation program(s), the nominal electric field, the ratio of an applied voltage to a gap size, was set as 0.5 V/μm with a gap size of 5 μm. As for the boundary conditions, the same voltage potential was applied to the edge of gaps and the simulated result was plotted with the strength of an electric field. It was considered that the simulated result represents an instant of the superimposed ac and dc electric field. When the gap shape was sharp, the highly concentrated electric field was found at the edge of the gap, shown in FIG. 8. It was observed that CNTs were not between electrodes but tangled around the gap. Smaller non-tubular particles were found between the electrodes.

Compared with the nominal electric field, the maximum electric field was 1.2 V/μm. At the tip of the gap, the strength of the electric field was rapidly changed. The width of quasi-stable region on the edge of the gap was under 1 μm. From a fabrication point of view, sub-micron scale errors can occur easily by micro-lithography, with the concern that an inadvertant or sharp gap could induce an undesired electric field.

Example 6

Figure 9:
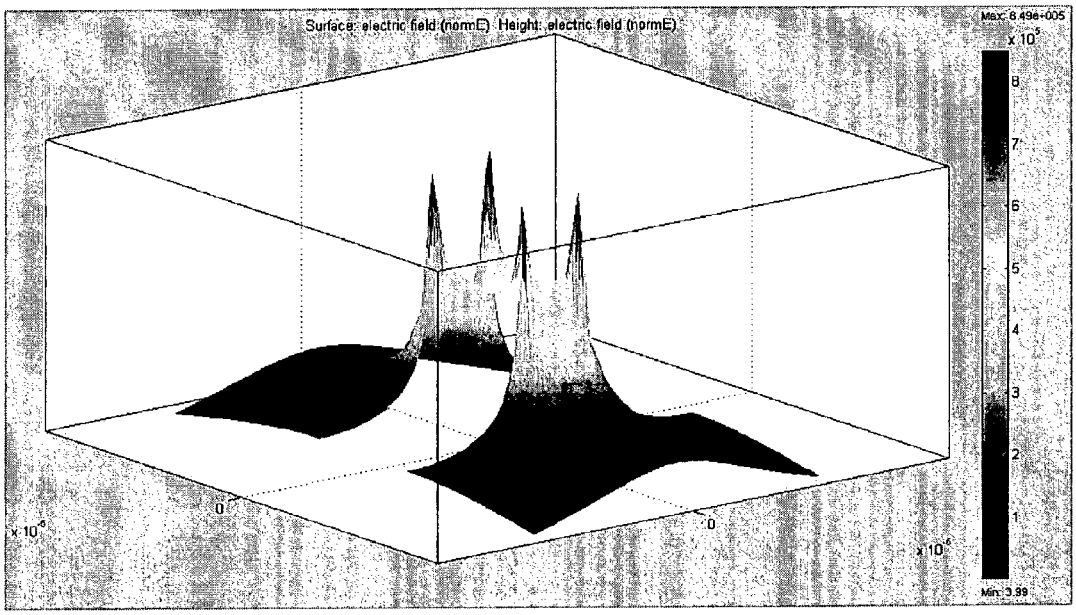
FIG. 9. Electric field simulation result on a square gap, nominal electric field=0.5 V/μm.

A square shape was simulated as illustrated in FIG. 9, but four concentrated electric field regions were found. Accordingly, CNTs can be deposited at either the edge of the square shape or the middle of the gap width, since the gradient of the electric field is 0 at those points.

Example 7

Figure 10:
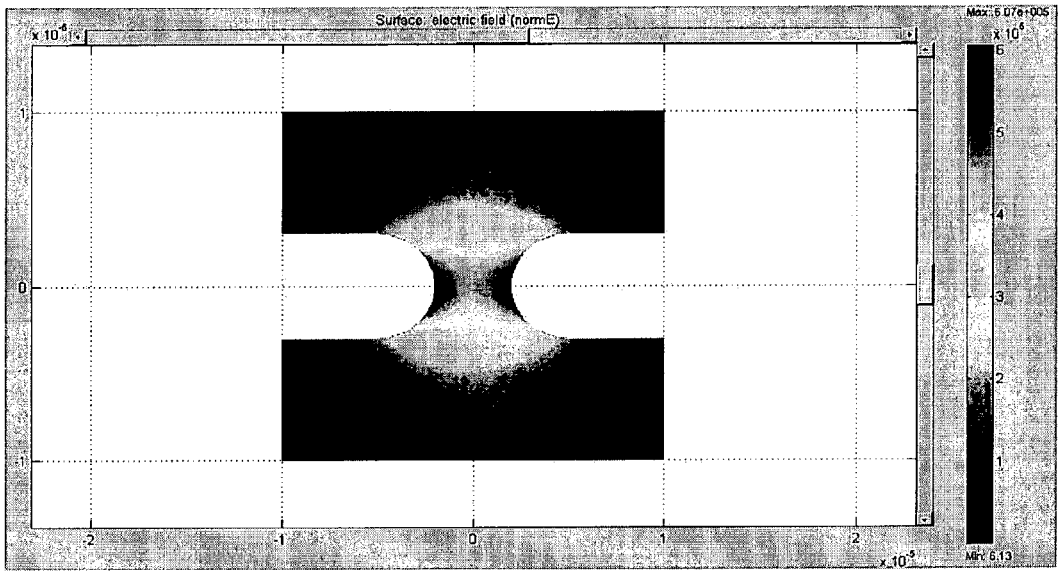
FIG. 10. Electric field simulation result on a semi-circular gap, nominal electric field=0.5 V/μm.
Figure 11:
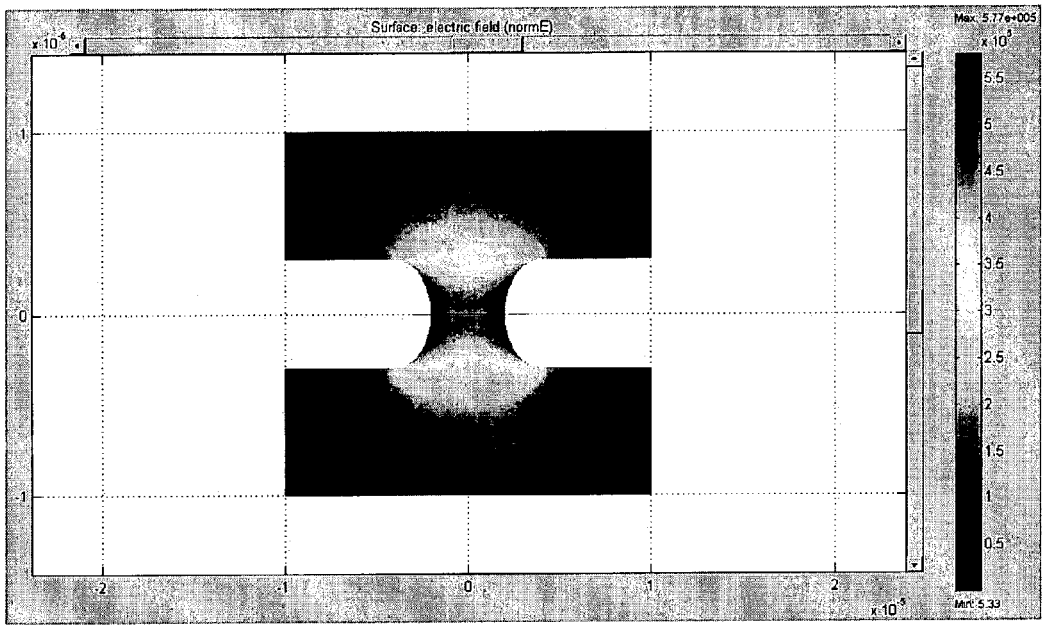
FIG. 11. Electric field simulation result on a semi-elliptical gap, nominal electric field=0.5 V/μm.
Figure 12:
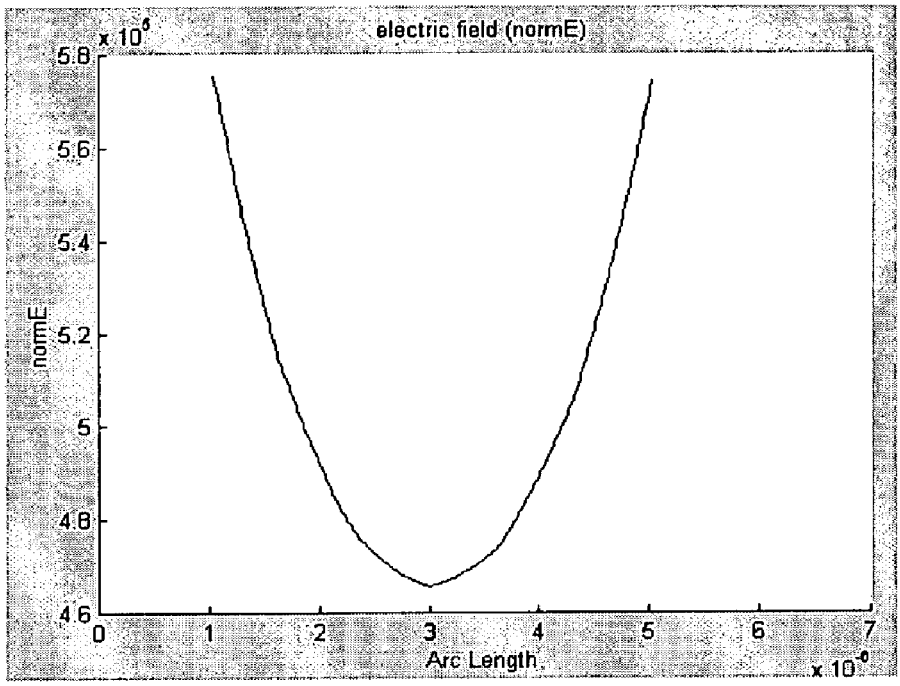
FIG. 12. Electric field distribution of the cross section on semi-elliptical gap, nominal electric field=0.5 V/μm.

It was found that a semi-circular gap shape could alleviate the concentration of a field strength—as shown in FIG. 10. A semi elliptical shape provided a more stable distribution of an electric field as shown in FIG. 11. The maximum and minimum values of the applied electric field were 0.53~0.57 V/μm which were close to the electric field strength of the nominal electric field, 0.5 V/μm. The electric field strength of the cross section on the gap was plotted FIG. 12. The particles can be placed where the arc length is 3 um, because the dielectrophoretic force becomes 0 at that point.

Example 8

Figure 13:
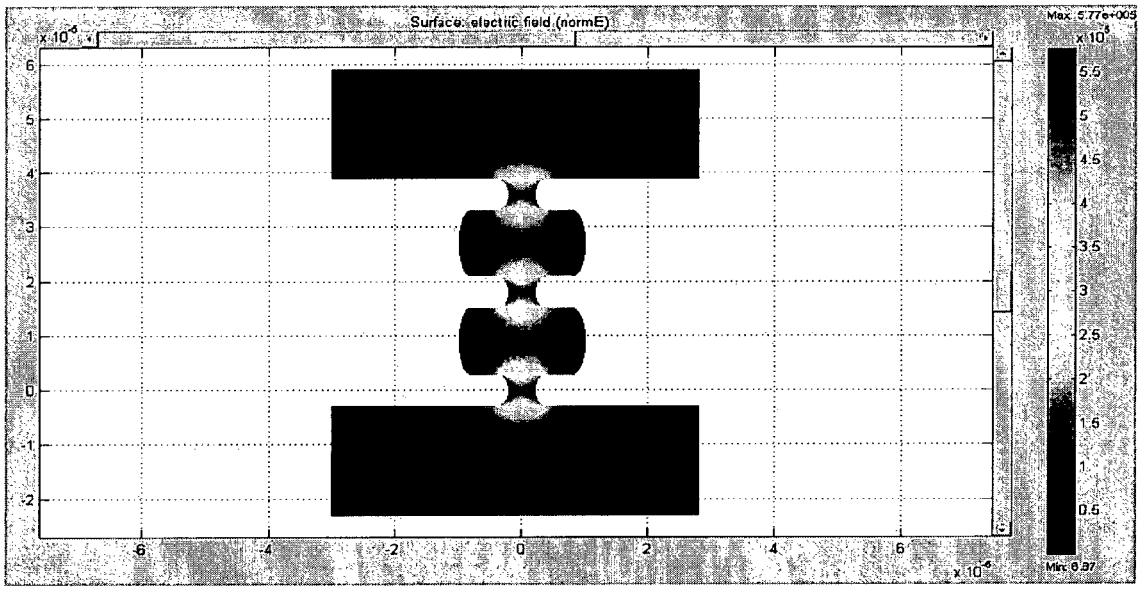
FIG. 13. Electric field simulation result on array, nominal electric field=0.5 V/μm.

An electric field in an array format was simulated using a plurality of semi-elliptical gap shapes. When a single gap was integrated as an array format, the distribution of the electric field changed and induced an interference between the gaps. The electric field strength of one gap overlapped with neighboring gaps. Since the distance between gaps should be minimized for a densely packed CNT array, a distance was empirically determined to maintain the strength of an electric field uniformly along the direction vertical to a gap. As observed, when the distance between pair of electrodes was twice larger than the gap width, the electric field became uniform as shown in FIG. 13. The resulting electric field distribution, however, was different from that of a single gap, and thus, a different ratio/tuning value of $E_{dc}/E_{ac}$ was required for array deposition.

A gap shape based on the simulation results of the preceding examples was designed and fabricated in the same way described. Since the resolution of a gap shape was limited by the resolution limit of photo-lithography, an exact gap shape could not be obtained. Arcuate gap shapes near either semi-elliptical form or semi-circular form were used to deposit a single CNT, as demonstrated in the following.

Example 9

Figure 14:
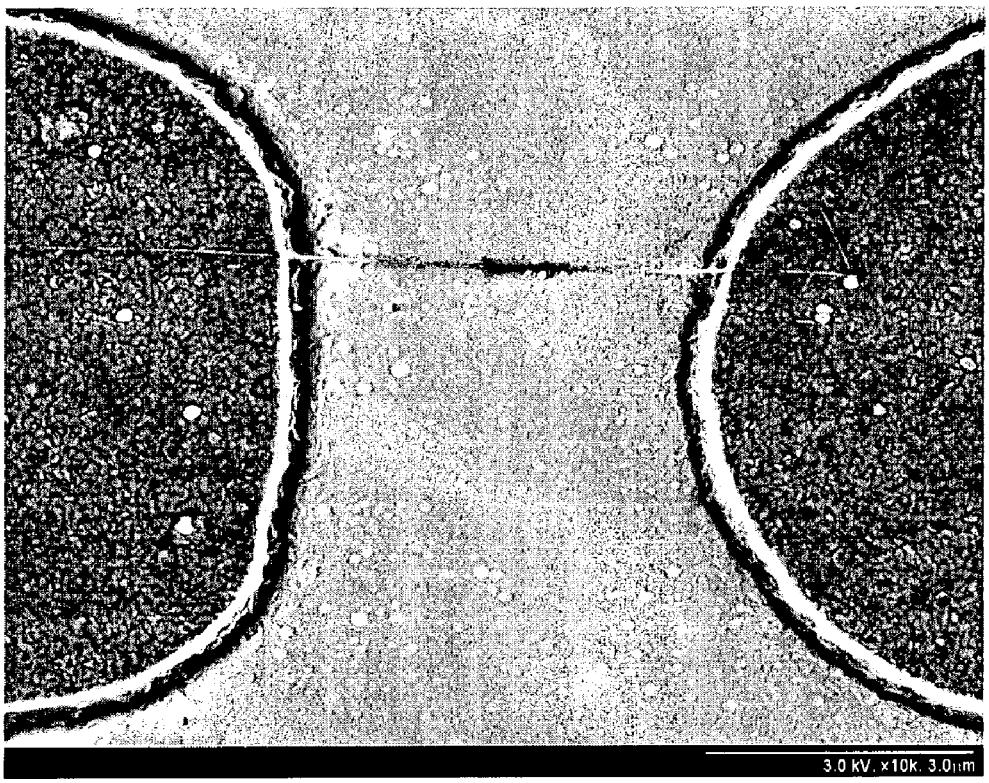
FIG. 14. Single MWCNT deposition with composite electric field guided assembly method, 0.544 $V_{rms}$/μm@5 MHz ($E_{DC}/E_{AC}=0.39$).

When the ratio of $E_{dc}/E_{ac}$ was 0.39 with the electric field strength of 0.544 $V_{rms}$/μm, a single CNT was deposited across the gap [FIG. 14]. The gap size was 4 μm and the deposited CNT was 7 μm long and 23 nm thick. The deposited CNT was overlapped on the both electrodes for electrical connection of the deposited CNT. The yield of a single CNT deposition was ~90% and fewer CNTs were attracted except for the deposited one.

Example 10

Figure 15:
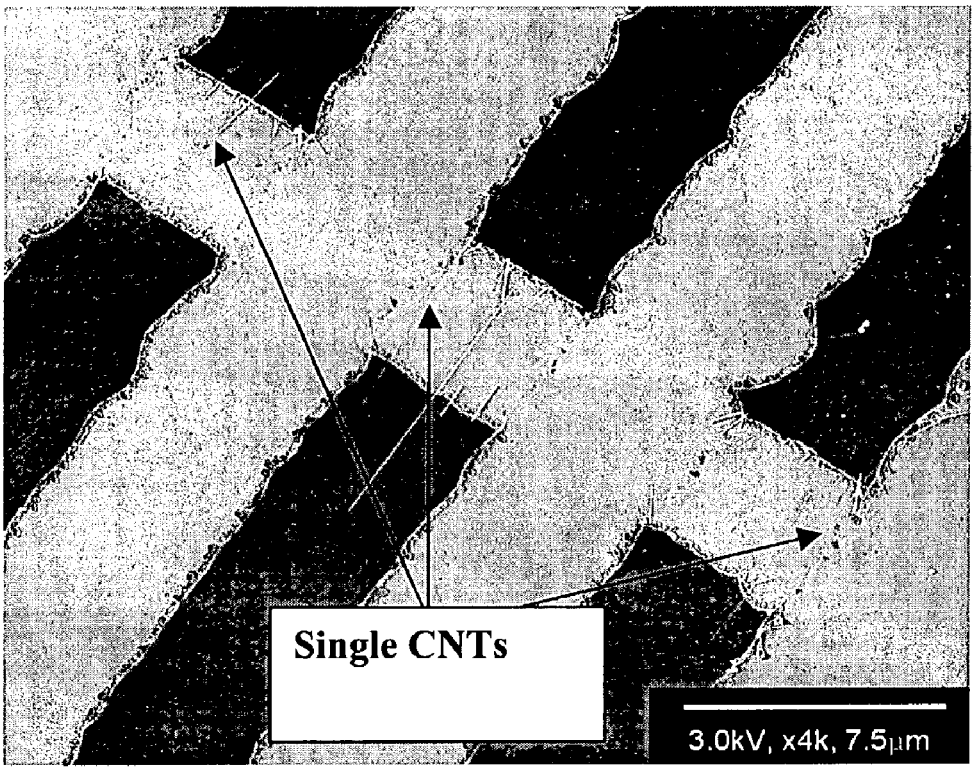
FIG. 15. Single MWCNT deposition on a square gap, 0.544 $V_{rms}$/μm@5 MHz ($E_{DC}/E_{AC}=0.39$).

In case of a simulated square shaped gap, six points were found where the gradient of the square of an electric field was 0. Therefore, CNTs could theoretically be deposited at each one or all of these points. An array of square shaped gaps was fabricated, and individual CNTs were found at either the corners or the middle point of a gap width, as expected [FIG. 15]. However, a gap was observed with no CNT attracted, reducing the yield of single CNT deposition under 30%. Presumably, the gap shape was not optimally square, illustrating possibly the micro-fabrication concern mentioned, above.

Example 11

Figure 16:
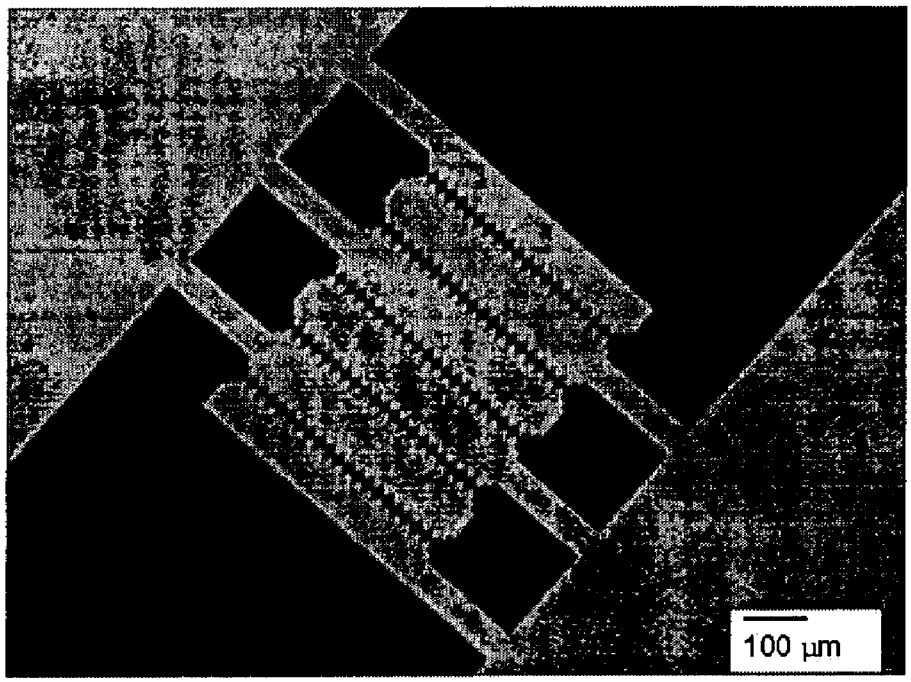
FIG. 16. Array of gaps for multiple CNT deposition.

The array of Al gaps was fabricated on $SiO_2$ (5000 Å) and the designed distance between two gaps in the array was three times larger than a single gap width [FIG. 16] to minimize interference. Since all gaps were connected into two large electrodes, an array of CNTs could be deposited in a single deposition process, and subsequently separated by an additional lithography process.

Example 12

Figure 17:
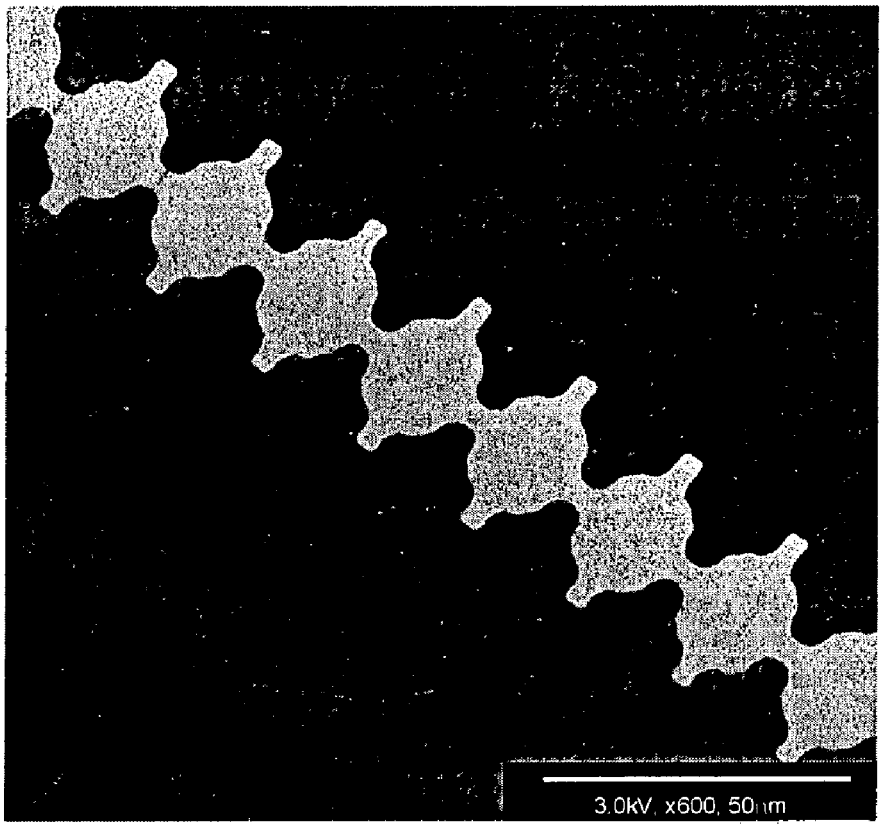
FIG. 17. Single CNTs deposition results on multiple gaps at $E_{dc}/E_{ac}$=0.348.
Figure 18:
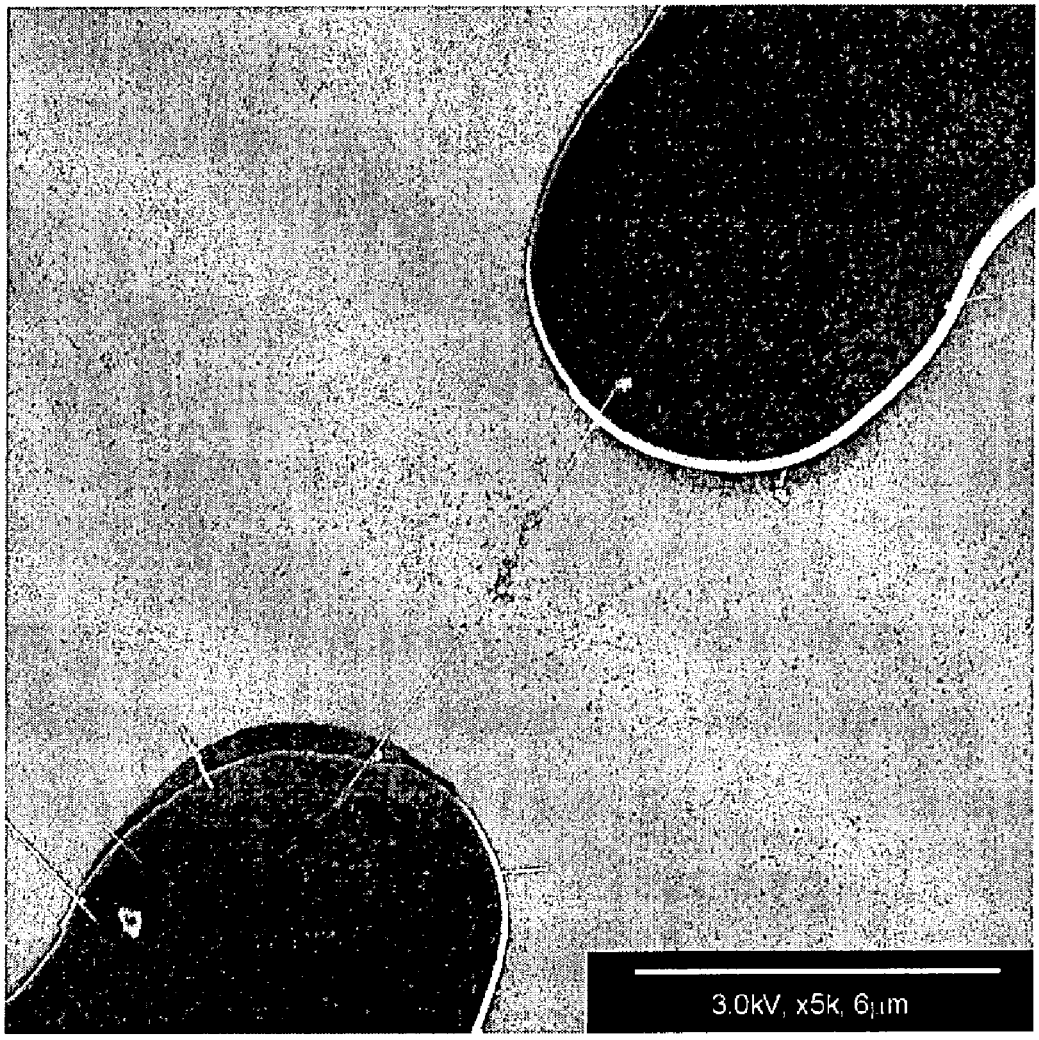
FIG. 18. Successful deposition case at $E_{dc}/E_{ac}$=0.348.

As mentioned above, for multiple gaps, the distribution of an electric field observed is different from that of a single gap and thus, a different tuning factor/ratio of $E_{dc}/E_{ac}$ is required to deposit single CNTs. Two or three CNTs were observed at each gap when the ratio was 0.39 which were applied to a single gap. The ratio was tuned to accomplish single CNT deposition on 100 gaps and favorable deposition results were shown at a ratio of 0.348 [FIG. 17]. Deposition result for 100 gaps was summarized in Table 1. FIG. 18 shows one of the successful depositions. There was no gap without CNTs attracted, but in some gaps, the deposited CNT was shorter than the gap size. This case was the most frequently observed failure mode (8%) and large particles sometimes occupied a gap instead of CNTs (2%). The yield was ~90% and is reproducible.

TABLE 1

Success (o) and failure (x) on 100 gaps (yield = 89%)

| No | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| F/S | O | O | o | O | o | o | o | o | o | o | o | o | o | o | o | o | o | o | o | o |
| No | 21 | 22 | 23 | 24 | 25 | 26 | 27 | 28 | 29 | 30 | 31 | 32 | 33 | 34 | 35 | 36 | 37 | 38 | 39 | 40 |
| F/S | O | O | o | X | o | o | o | o | o | o | o | o | o | o | o | o | o | o | o | o |
| No | 41 | 42 | 43 | 44 | 45 | 46 | 47 | 48 | 49 | 50 | 51 | 52 | 53 | 54 | 55 | 56 | 57 | 58 | 59 | 60 |
| F/S | O | O | o | O | o | o | x | o | o | x | o | o | o | o | o | o | o | o | o | o |
| No | 61 | 62 | 63 | 64 | 65 | 66 | 67 | 68 | 69 | 70 | 71 | 72 | 73 | 74 | 75 | 76 | 77 | 78 | 79 | 80 |
| F/S | O | O | x | X | o | o | o | o | o | o | o | x | o | x | o | o | o | o | o | o |
| No | 81 | 82 | 83 | 84 | 85 | 86 | 87 | 88 | 89 | 90 | 91 | 92 | 93 | 94 | 95 | 96 | 97 | 98 | 99 | 100 |
| F/S | O | O | o | O | o | x | o | x | o | x | o | o | o | o | x | o | o | o | o | o |

Example 13a

In addition to the preceding parameters (e.g., electric field strength, the ratio of $E_{dc}/E_{ac}$, gap shape, gap size, and the distance between two gaps) the dilution of CNTs and drying-out time for CNT deposition were found to affect deposition. For example, if CNTs are highly diluted and the CNT suspended solution is quickly dried out, deposition was adversely affected.

Example 13b

CNTs suitable for deposition can be grown with either an arc-discharge method, chemical vapor deposition method, or laser ablation method—or as would otherwise be known in the art. Straight CNTs provide, generally, higher deposition yields.

Dilution of MWCNTs in ethanol is a useful delivery system. Other solvents (e.g., acetone, methanol, etc.) can be used with good effect, but ethanol is preferred in that the rate of dehydration can be used to control the drying-out time. Successive dilutions can be utilized until the resulting medium becomes clear (e.g., 10 ng/ml, in ethanol).

A diluted liquid medium should be sonicated for several hours. After sonication, a drop of the medium can be dried in air and observed using SEM, AFM, TEM, etc. Such a solution is best used in conjunction with the present invention if the CNTs are completely separated. If separation is not observed, sonication should be repeated, as necessary.

Example 13c

Figure 19:
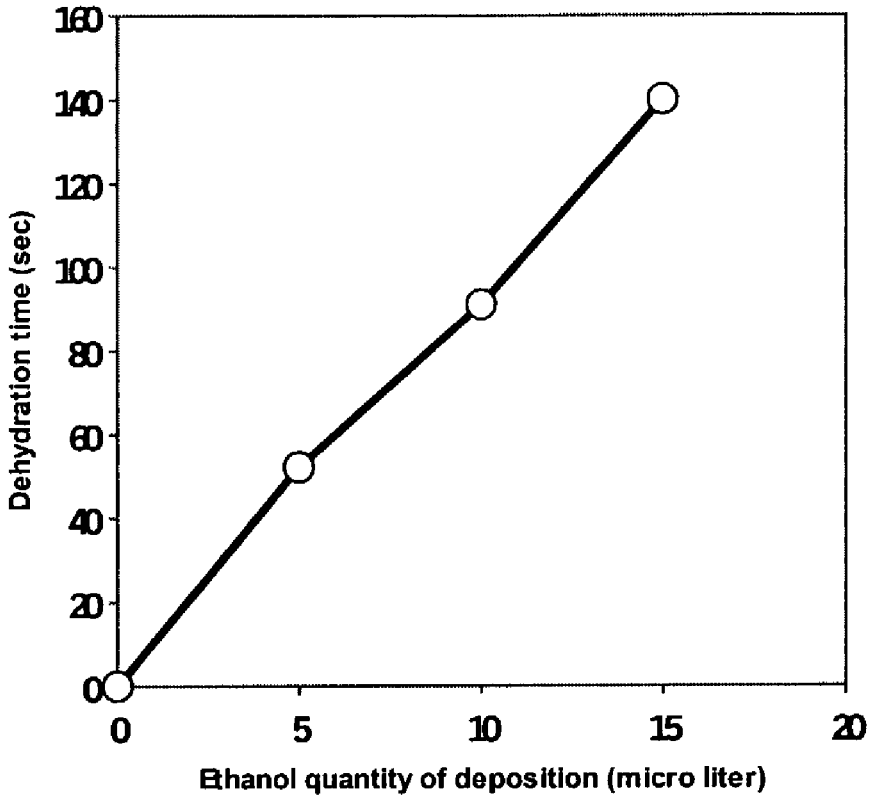
FIG. 19. Ethanol volume for deposition vs. drying out time.

FIG. 19 shows the dehydration time of ethanol medium of MWCNTs. When 10 μl of ethanol/CNTs was dropped on $SiO_2$ surface, it spread out in a few seconds and dried out in 90 seconds. In this experiment, 6 μl of an ethanolic medium of CNTs was used to deposit a single CNT on a gap, while 9 μl of ethanol was used for an array. It was observed that a lesser amount or volume at a given concentration provided cleaner results with fewer particles, but with lower yield. On the other hand, a larger amount/volume gave better yield, but more particles were attracted: round non-elongated particles that slowly responded to high frequency of an ac electric field had enough time to be attracted before the solution dried out. With reference to example 13 and depending on CNT concentration, the volume of an applied liquid medium can be used to control the time before drying. The results of this example also support use of more purified CNTs with uniform length to provide good deposition.

Example 14

SWCNTs can also be deposited with an composite electric field in accordance with this invention. It was observed that SWCNTs attracted with an electric field at an appropriate frequency (e.g. 5 MHz) were placed across an electrode gap.

Example 15

Figure 20:
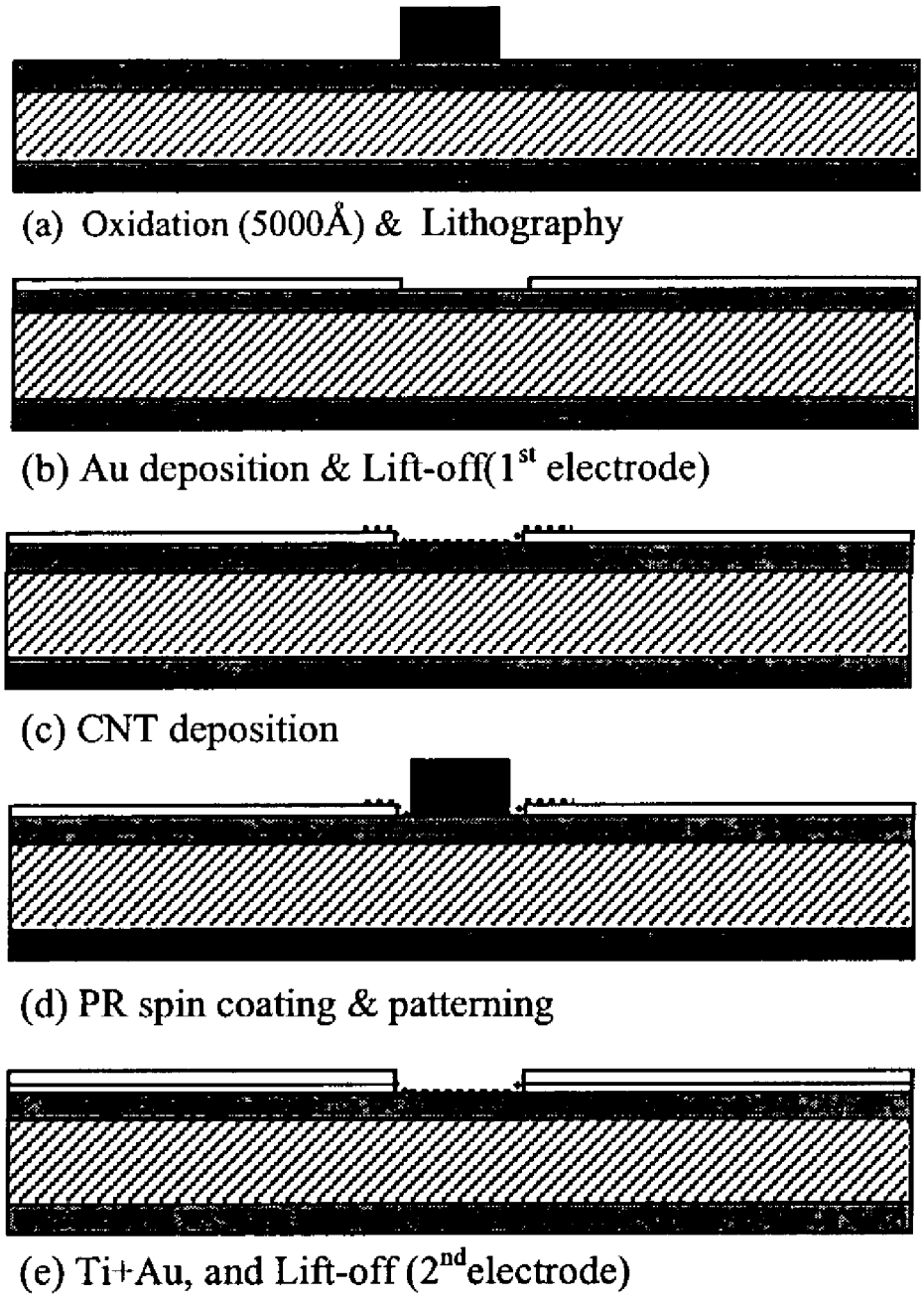
FIG. 20. Fabrication process of a CNT device.
Figure 21:
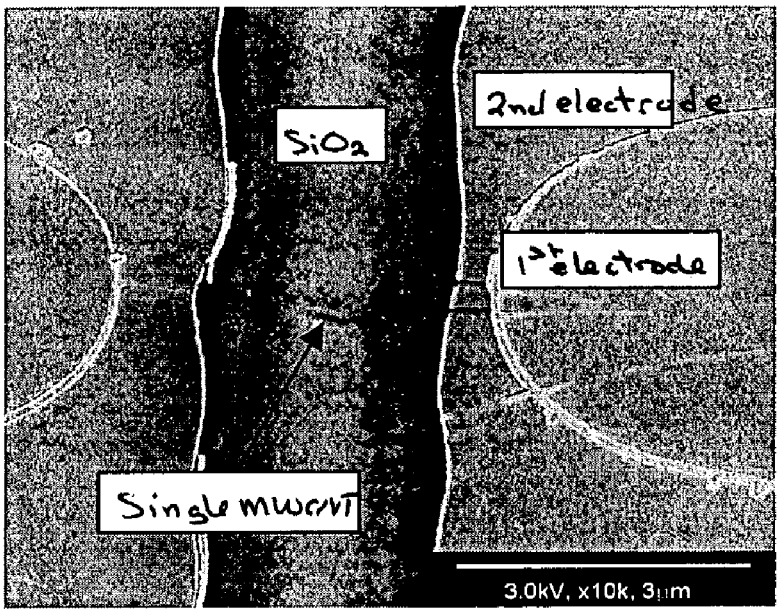
FIG. 21. A simple CNT device (a) Ti and Au layer ($2^{nd}$ electrodes) selectively evaporated on the deposited single MWCNT on the $1^{st}$ electrodes (b) I-V curve characteristics of MWCNTs.
Figure 21:
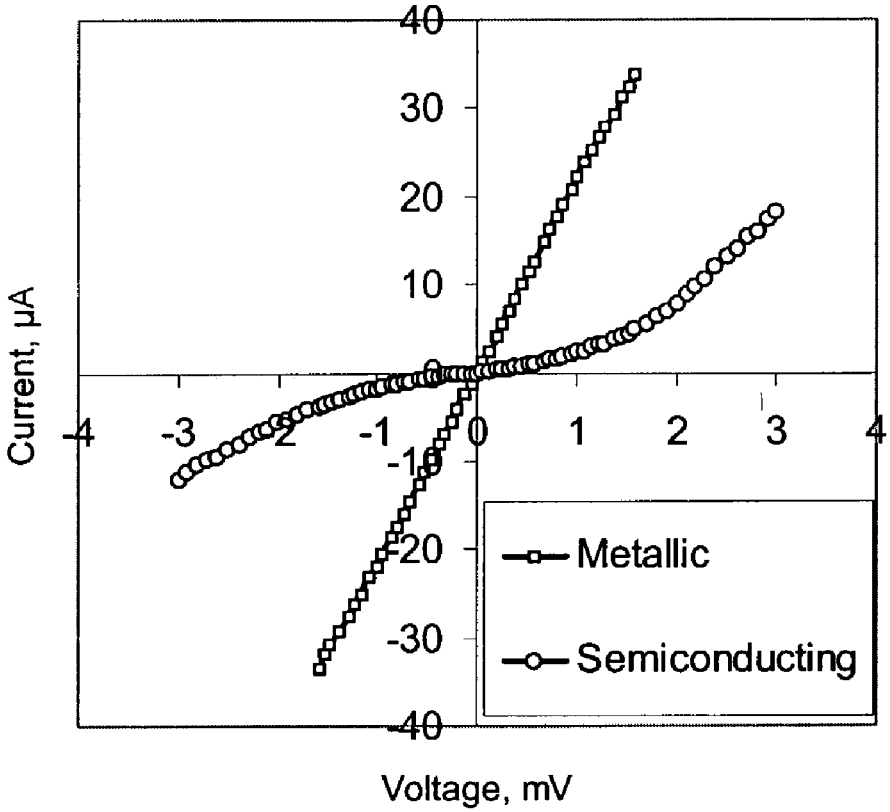

An MWCNT deposited across a gap provides an energy barrier, a coulomb blockade between a metal layer and a MWCNT. In order to obtain an ohmic contact, Ti and Au layers can be deposited on a CNT. FIG. 20 shows the fabrication process of a simple CNT device to accomplish an electrical contact. A Si wafer was thermally oxidized and a photo resist (PR) material was patterned atop. Ti (300 Å) and Au (300 Å) were evaporated and a gap of a few μm was created by removing PR in acetone. A single CNT was deposited in accordance herewith and PR was patterned again to hold the deposited CNT on the substrate and to selectively evaporate Ti (300 Å) and Au (300 Å) on both ends of the CNT. The PR was removed, with acetone, and the final device was shown in FIG. 21(*a*). A single MWCNT was attracted by using a first set of electrodes (roundly-shaped) and a second set of electrodes (square-shaped) were deposited additionally for electrical connection. Although a few CNTs were deposited around the first electrodes, only one CNT could be electrically connected and the other CNTs were not stretched across both electrodes.

The electrical resistance of these CNTs was measured at ~100 kΩ with an ohm meter. Additionally, the semiconducting or metallic behavior was observed in the investigation of the I-V characteristics as in FIG. 21(*b*), which were consistent with the previous literature.

Example 16

The method(s) of this invention can be used in conjunction with one of three kinds of fabrication processes. First, direct deposition on a trenched gap; a second involves dry-etching after deposition; and a third uses wet etching (e.g. HF solution) after deposition.

Example 16a

Figure 23:
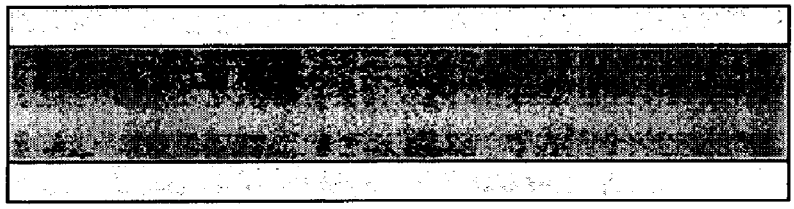
FIGS. 23-25. Fabrication techniques for a device with suspended CNT illustrated, stepwise, in conjunction with the present invention.
Figure 23:
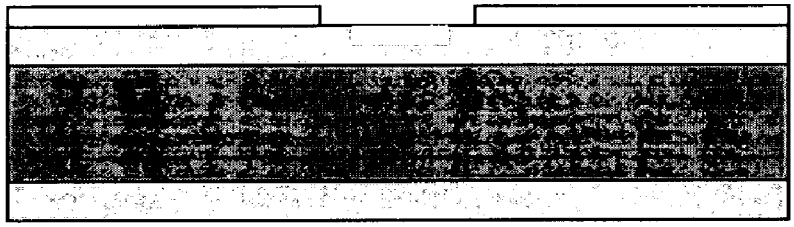
Figure 23:
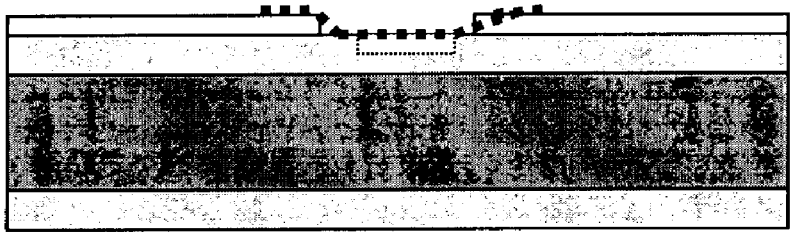
Figure 23:
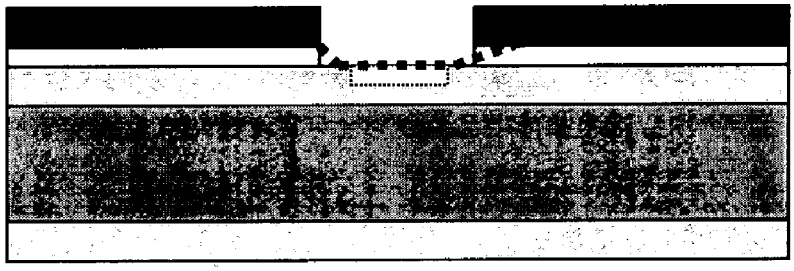

FIG. 23 shows a fabrication process in the art which can be used for a direct suspension of CNT over a substrate portion. A component of this method is to fabricate a trench whose size is smaller than the gap size, since an electrohydrodynamic and a electrophoretic flow is formed at the edge of electrodes. For example, if the gap size is 6 μm, the trench size is preferably 4 μm with a depth of about 500 nm. A depth under ~300 nm for such a gap distance can collapse the CNT owing to surface tension. This method is used with good effect for a thin CNT (e.g. the diameter of a CNT is 20 nm).

Example 16b

Figure 24:
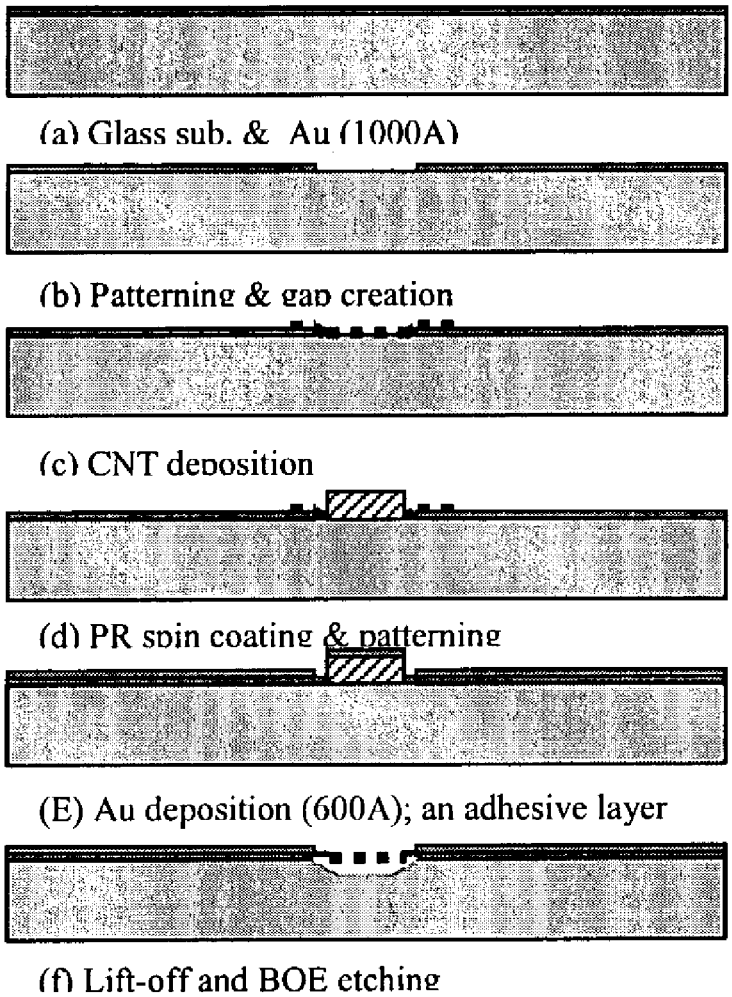

FIG. 24 illustrates CNT suspension with an adhesive layer and glass etching; the deposition yield in conjunction with this fabrication technique can be somewhat less than that of the direct deposition. An advantage of this technique is a trench depth greater than a few microns. Yield can be improved, in conjunction with this technique through use of a supercritical $CO_2$ release, as would be known by those skilled in the art made aware of this invention. Again, the fabrication technique is known in the art, but hereby demonstrated in conjunction with the present invention.

Example 16c

Figure 25:
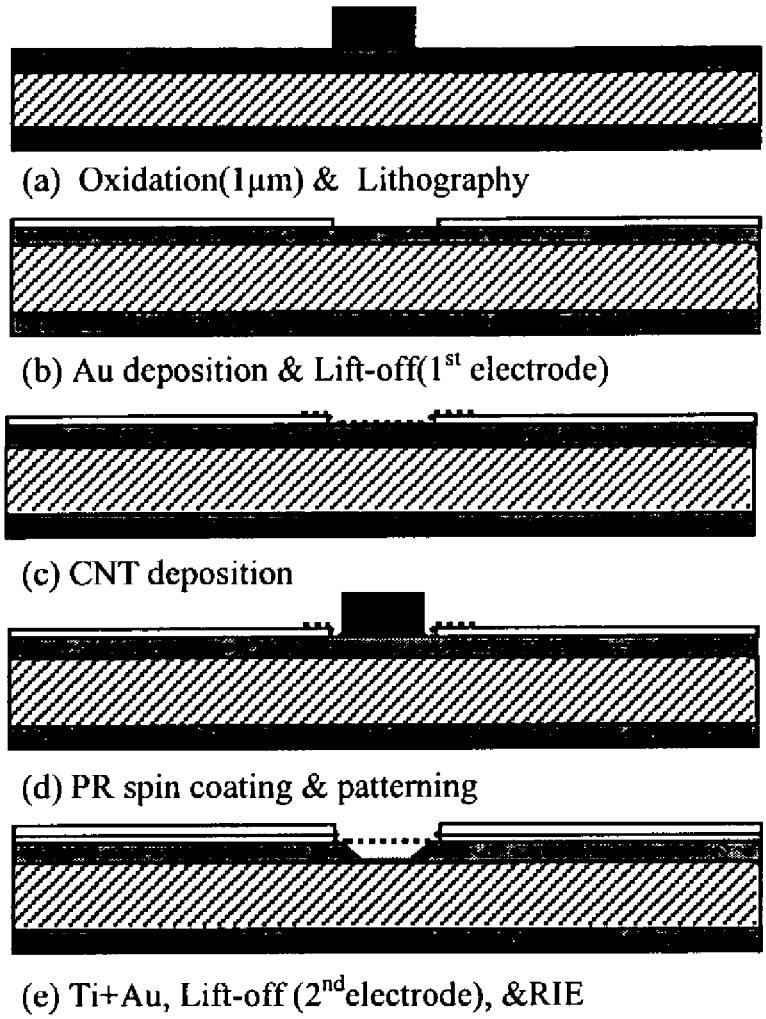

FIG. 25 illustrates CNT suspension with a dry etching, best applicable to thick CNTs with a diameter larger than 20 nm. A useful aspect of such a technique (and that illustrated by the preceding example) is the ability to etch the substrate after CNT deposition.

Example 17

Figure 26A:
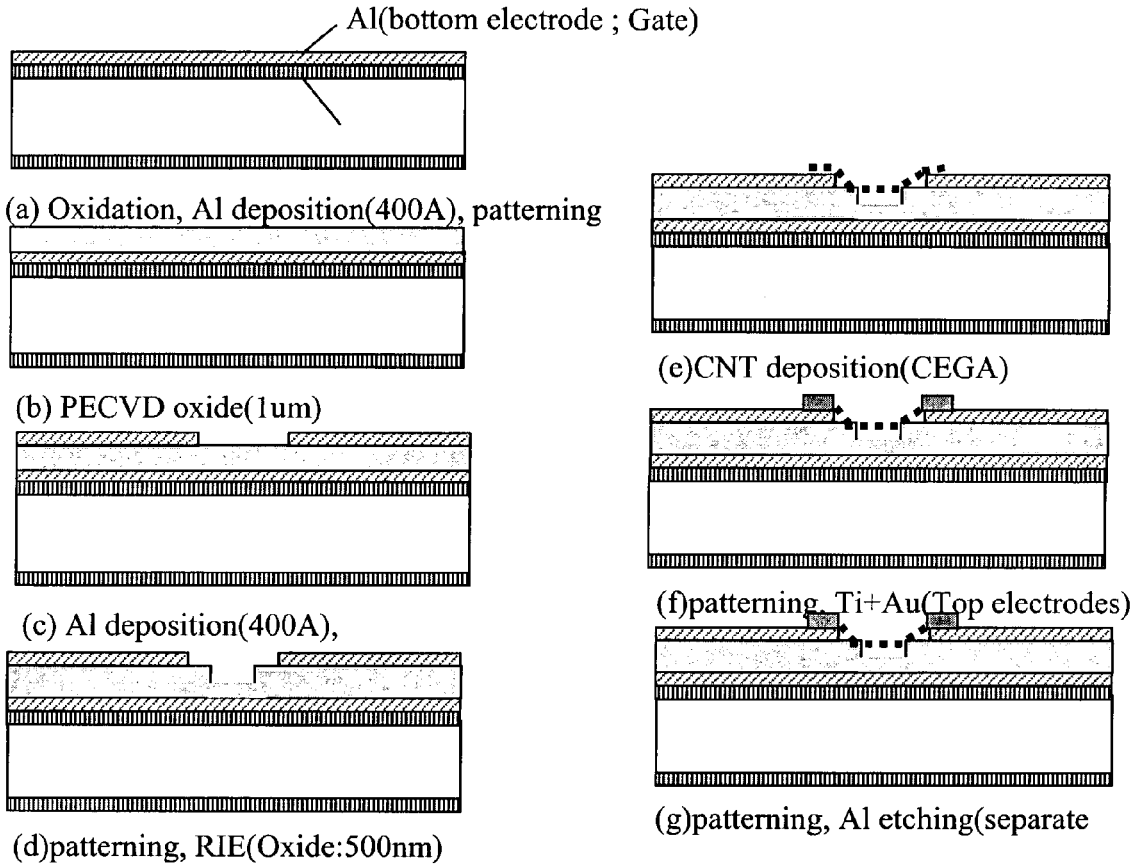
FIG. 26(*a*). A schematic illustration of a fabrication technique useful in conjunction with deposition methods of this invention; (b) a 3-dimensional perspective of several fabrication steps of (a); and (c) a micrograph of a typical resulting electrode array, showing CNT deposition.
Figure 26B:
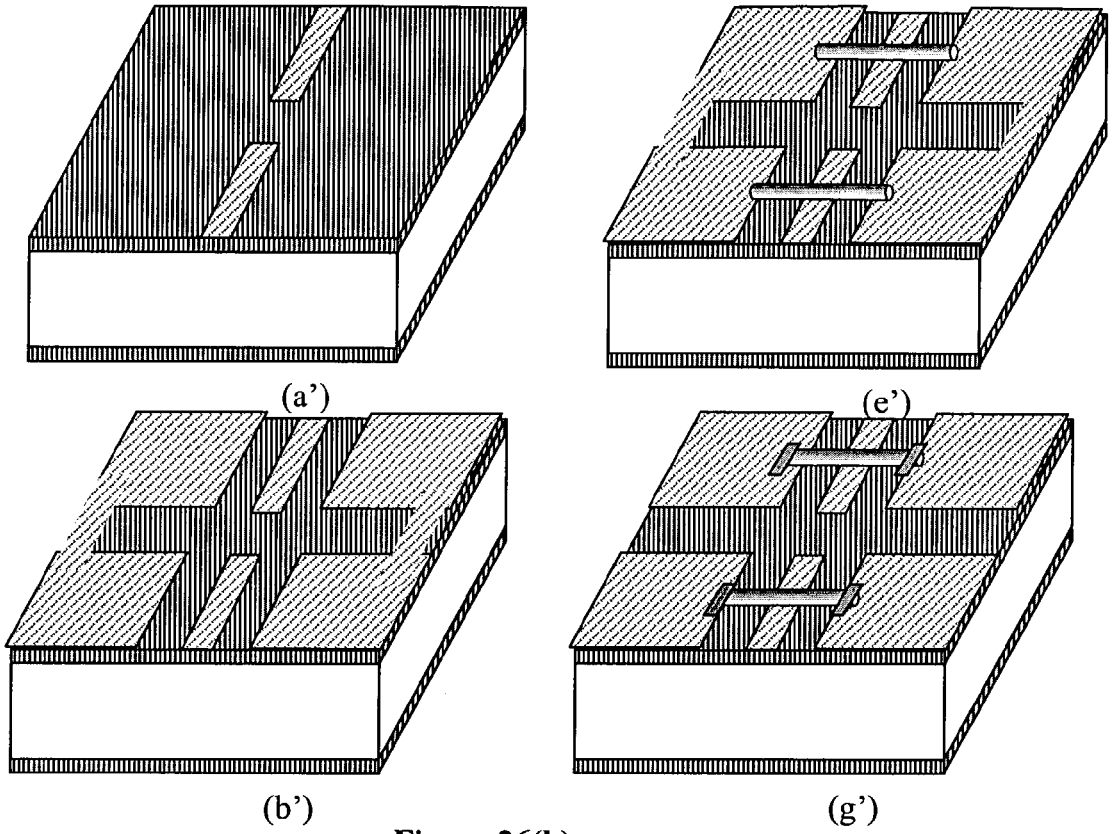
Figure 26C:
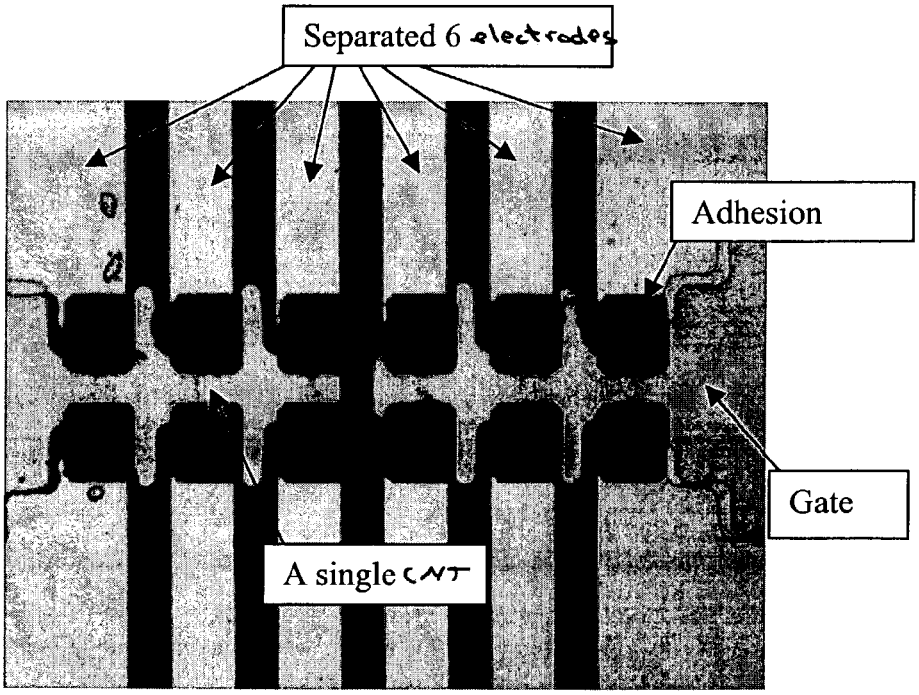

In some applications of this invention, it can be advantageous to separate electrodes in order to address (i.e., actuate and sense) individual CNTs. The CNTs may also need to be suspended for some applications that requires mechanical actuation (e.g., bending). FIGS. 26(*a*)-(*c*) schematically illustrate another fabrication process to suspend CNTs across a trench and separate the electrodes for individual addressing. Such steps can be used to fabricate, for instance, an array of electro-mechanically operated FETs (field effect transistors).

In step (a) of FIG. 26(*a*), Al is deposited and patterned for the actuation electrode under the trench. It will apply electrostatic force to a CNT, and the conductance of the CNT will vary as a result of the bending by the electrostatic force. Steps (b)-(c) are as illustrated and understood by those in the art.

In step (d) of FIG. 26(*a*), a stepped trench is created by reactive ion etching (RIE). This particular shape of the trench is especially useful in suspending CNTs. With a simple trench that has no step, it was observed that the deposited CNTs were completely sagged along the surface of trench. Subsequent actuation may be difficult in this case. With the particular trench illustrated, the CNTs were all suspended.

In the steps following deposition (e), CNTs can be immobilized and the electrodes are separated by known patterning techniques. Specific layers of metals (e.g., Ti+Au) are evaporated and patterned to provide firm mechanical bonding and electrical connection with low contact resistance. Then, the electrodes are separated by photo-lithography and wet etching. A 3-dimensional illustration of several steps is presented in FIG. 26(*b*). A micrograph of the resulting device is shown in FIG. 26(*c*).

While the principles of this invention have been described in connection with specific embodiments, it should be understood clearly that these descriptions are added only by way of example and are not intended to limit, in any way, the scope of this invention. Other advantages and features will become apparent from the claims hereinafter, with the scope of such claims as understood by those skilled in the art.

We claim:

1. A method of depositing a carbon nanotube, said method comprising:

providing a first electrode at a distance from a second electrode, said electrodes on a substrate and comprising a first electrode pair;

introducing at least one carbon nanotube proximate said electrodes; and generating a composite electric field between said electrodes, said field having an ac electric field component and a dc electric field component, said composite electric field depositing a carbon nanotube across said electrode pair.

2. The method of claim 1 wherein a ratio of said dc electric field component to said ac electric field component is adjusted, at an applied voltage over said distance.

3. The method of claim 2 wherein said ac electric field component is sufficient to attract a carbon nanotube toward said electrodes, and said dc field component is sufficient to align said carbon nanotube between said electrodes.

4. The method of claim 1 wherein a gradient of said electric field between said electrodes is zero.

5. The method of claim 4 wherein each said electrode comprises an arcuate peripheral configuration.

6. The method of claim 4 wherein each said electrode comprises a square peripheral configuration.

7. The method of claim 1 wherein a second electrode pair is provided at a distance from said first electrode pair.

8. The method of claim 7 providing an array of electrode pairs for carbon nanotube deposition therebetween.

9. The method of claim 8 wherein said electric field is distributed over said electrode pairs.

10. The method of claim 9 wherein a ratio of said dc electric field component to said ac electric field component is adjusted, at an applied voltage over electrodes of each said pair.

11. The method of claim 10 wherein a gradient of said electric field between each said pairs of electrodes is zero.

12. The method of claim 1 wherein a liquid dispersion of carbon nanotubes is introduced proximate said electrodes, said nanotubes selected from single-walled carbon nanotubes and multi-walled carbon nanotubes.

13. The method of claim 1 wherein said electrodes are removed from said substrate.

14. A method of using a composite electric field to enhance single carbon nanotube deposition, said method comprising:

introducing a plurality of carbon nanotubes proximate to a pair of electrodes; and applying a composite electric field across said electrodes, said field comprising a dc electric field component concurrent with an ac electric field component, said ac and dc components together sufficient to attract said carbon nanotubes to said electrode pair and align a single carbon nanotube thereacross.

15. The method of claim 14 wherein a ratio of said dc electric field component to said ac electric field component is adjusted, at an applied voltage across said electrodes.

16. The method of claim 14 wherein said ac electric field component is sufficient to attract a carbon nanotube toward said electrodes, and said dc electric field component is sufficient to align said carbon nanotube between said electrodes.

17. The method of claim 16 wherein said dc electric field component across said electrodes is reduced upon deposition of a carbon nanotube there between.

18. The method of claim 14 wherein a gradient of said composite electric field between said electrodes is zero.

19. The method of claim 14 wherein said electric field comprises a plurality of regions having a zero gradient, and a single carbon nanotube is deposited in each said region.

20. The method of claim 14 wherein said carbon nanotubes are selected from single-walled carbon nanotubes and multi-walled carbon nanotubes.

* * * * *

UNITED STATES PATENT AND TRADEMARK OFFICE

CERTIFICATE OF CORRECTION

PATENT NO. : 7,381,316 B1
APPLICATION NO. : 10/426925
DATED : June 3, 2008
INVENTOR(S) : Junghoon Lee and Jaehyun Chung It is certified that error appears in the above-identified patent and that said Letters Patent is hereby corrected as shown below:

Col. 2, Line 37 "(a) de e-field" should be -- (a) dc e-field --

Col. 9, Lines 52-53 Equation 4

$$E_{rms} = \sqrt{E_{ac}^{2}/2E_{dc}^{2}}$$

should be

-- $$E_{rms} = \sqrt{E_{ac}^{2}/2 + E_{dc}^{2}}$$ -- (4)

Signed and Sealed this

Seventeenth Day of March, 2009

John Doll

JOHN DOLL
*Acting Director of the United States Patent and Trademark Office*